US006566794B1

(12) United States Patent
Miyazaki

(10) Patent No.: US 6,566,794 B1
(45) Date of Patent: May 20, 2003

(54) IMAGE FORMING APPARATUS HAVING A SPACER COVERED BY HEAT RESISTANT ORGANIC POLYMER FILM

(75) Inventor: Kazuya Miyazaki, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/357,555

(22) Filed: Jul. 20, 1999

(30) Foreign Application Priority Data

Jul. 22, 1998 (JP) ..... 10-206594

(51) Int. Cl.[7] ..... H01J 1/88; H01J 19/42; H01K 1/18

(52) U.S. Cl. ..... 313/292; 313/495; 313/238; 313/482

(58) Field of Search ..... 313/495, 497, 313/496, 292, 422, 258, 482, 283–288, 257, 493, 238

(56) References Cited

U.S. PATENT DOCUMENTS

| | | | | |
|---|---|---|---|---|
| 5,063,327 A | * | 11/1991 | Brodie et al. | 313/495 |
| 5,371,433 A | * | 12/1994 | Horne et al. | 313/495 |
| 5,726,529 A | * | 3/1998 | Dean et al. | 313/495 |
| 6,153,973 A | * | 11/2000 | Shibata et al. | 313/495 |

FOREIGN PATENT DOCUMENTS

| | | | |
|---|---|---|---|
| JP | 57-118355 | | 7/1982 |
| JP | 61-124031 | | 6/1986 |
| JP | 2000195413 A | * | 6/2000 |

OTHER PUBLICATIONS

Burke, "Secondary Emission from Polymers", IEEE Trans. Nucl. Sci., vol. NS–27, No. 6 (1980) pp.1760–1764.

* cited by examiner

*Primary Examiner*—Michael H. Day
*Assistant Examiner*—Mariceli Santiago
(74) *Attorney, Agent, or Firm*—Fitzpatrick, Cella, Harper & Scinto

(57) ABSTRACT

An image forming apparatus has an envelope including as constituent elements first and second substrates spaced by some distance an electron source and an image forming member for forming an image upon irradiation of electrons from the electron source, the electron source and the image forming member being disposed in the envelope and a spacer for maintaining the distance between the first and second substrates, wherein the spacer is conductive and has a heat resistant organic polymer film formed on the surface of the spacer or the spacer is constituted of an insulating base member, a conductive film formed on the insulating base member, and a heat resistant organic polymer film formed on the conductive film.

12 Claims, 12 Drawing Sheets

IMAGE FORMING APPARATUS HAVING A SPACER COVERED BY HEAT RESISTANT ORGANIC POLYMER FILM

BACKGROUND OF THE INVENTION

1. Field of the Invention

The present invention relates to an image forming apparatus with electron emitting elements.

2. Related Background Art

Attention has been paid to a thin flat type display because it requires less space and is light in weight so that it is expected that a CRT type display is replaced by the flat type display. Present flat type displays include a liquid crystal type, a plasma light emission type, and a multi electron source type. Of these, the plasma light emission type display and multi electron source type displays have a large angle of view and an image quality comparable to a CRT display, and can display an image of high definition.

Such an image forming apparatus has a rear plate, a face plate, a support frame, and spacers. The rear plate has an electron source made of a number of electron emitting elements. The face plate has a fluorescent member. The rear plate and face plate together with the support frame constitute a vacuum envelope. The spacers define the distance between the face and rear plates. As the electron emitting elements, cold cathode elements capable of being mounted at a high density have been developed, such as field emission type electron emitting elements which emit electrons from a conical or needle-like tip and surface conduction type electron emitting elements.

As a display area of a display becomes large, it becomes necessary to make the back and face plates thick in order to prevent the vacuum envelope from being deformed by a difference between the inner vacuum and external atmospheric pressure. This not only increases the weight of the display but also makes an image distorted as viewed obliquely. In order to make the vacuum envelope resistant against the atmospheric pressure by using relatively thin members, structure support members called spacers or ribs are disposed between the back and face plates. A distance between the back plate with the electron source and the face plate with the fluorescent member is maintained at submillimeter or several millimeter and the inside of the vacuum envelope is maintained at a high vacuum. In order to accelerate electrons emitted from the electron source, a high voltage of several hundred V or higher is applied between the fluorescent member and the electron source. Namely, a high electric field of an electric field intensity over 1 kV/mm is applied between the fluorescent member and the electron source. Electric discharge at the structure support member such as spacers is therefore feared.

A spacer is electrically charged when electrons emitted from the electron source or some electrons reflected from the fluorescent member side collide with the spacer or when positive ions ionized by emitted electrons attach the spacer. If the spacer is electrically charged, the trajectory of electrons emitted from the electron source may be bent and the electrons reach the fluorescent member at a position different from a normal position. Therefore, an image near at the spacer is displayed distorted as viewed from the face plate side.

In order to solve this problem, it has been proposed to flow a small current through the spacer to remove electric charges (e.g., JP-A-57-118355, JP-A-61-124031). According to this technique, a semiconductive film is formed on the surface of an insulating spacer to allow a small current to flow through the spacer surface. A charge preventive film used according to this technique is a tin oxide thin film, a thin film of mixed crystal of tin oxide and indium oxide, or a metal film.

A semiconductive thin film such as tin oxide used by the above-described technique is so sensitive to gas such as oxygen as to be applied to a gas sensor, so that the resistance value of the thin film is likely to be changed with ambient atmosphere. These materials and metal films have a small specific resistance. it is therefore necessary to form an island-shaped film or a very thin film in order to make it semiconductive. A conventional charge preventive film is therefore difficult to be formed and is likely to change its resistance value during a heat treatment such as frit sealing and baking during display manufacture steps.

SUMMARY OF THE INVENTION

It is an object of the invention to provide an image forming apparatus capable of forming a high quality image.

It is another object of the present invention to provide an image forming apparatus capable of forming a high quality image, by suppressing the influence of spacers disposed in the image forming apparatus upon the image forming performance as much as possible.

In order to achieve the above objects, the invention provides an image forming apparatus comprising: an envelope including as constituent elements first and second substrates spaced by some distance; an electron source and an image forming member for forming an image upon application of electrons from the electron source, the electron source and the image forming member being disposed in the envelope; and spacers for maintaining the distance between the first and second substrates, wherein the spacer is conductive and has a heat resistant organic polymer film formed on the surface of the spacer.

The invention also provides an image forming apparatus comprising: an envelope including as constituent elements first and second substrates spaced be some distance; an electron source and an image forming member for forming an image upon application of electrons from the electron source, the electron source and the image forming member being disposed in the envelope; and spacers for maintaining the distance between the first and second substrates, wherein the spacer comprises an insulating base member, a conductive film formed on the insulating base member, and a heat resistant organic polymer film formed on the conductive film.

BRIEF DESCRIPTION OF THE DRAWINGS

FIG. 3A is a plan view and FIG. 3B is a partially enlarged plan view.

DETAILED DESCRIPTION OF THE PREFERRED EMBODIMENTS

Figure 1:
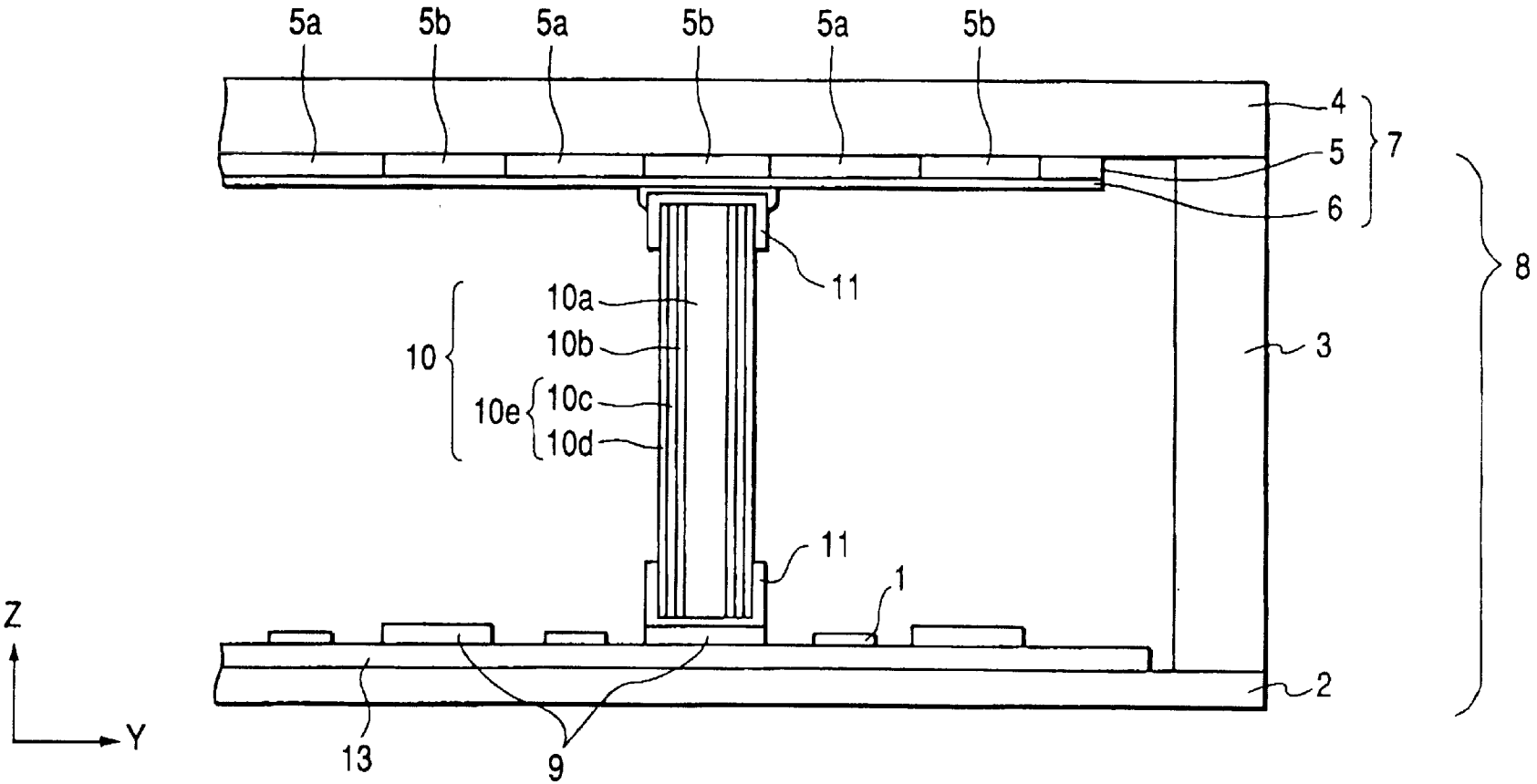
FIG. 1 is a schematic cross sectional view showing a portion of an image forming apparatus of the invention.

In an image forming apparatus, a charge preventive film of a conductive film covers the surface of an insulating member in an envelope,, including an electron source and an image forming member for forming an image upon application of electrons from the electron source. The charge preventive film removes charges accumulated on the surface of the insulating member. The surface resistance (sheet resistance Rs) of the charge preventive film is preferably set to $10^{12}\Omega$ or smaller. More preferably, the sheet resistance Rs is set to $10^{11}\Omega$ or smaller in order to obtain a sufficient charge removable effect. The lower the sheet resistance, the charge removal effect becomes better.

If the charge preventive film is applied to the image forming apparatus, particularly to its spacers, the surface resistance value Rs of the spacer is set in a range suitable from the view point of charge prevention and power consumption. Although the lower the resistance value, the quicker the charge accumulated in the spacer can be removed, a power to be consumed in the spacer becomes larger. The charge preventive film of a spacer is more preferably a film made of semiconductive material than a film made of metal having a smaller specific resistance. The reason for this is that if a film made of metal having a small specific resistance is used as the charge preventive film, the charge preventive film is required to have a very thin film thickness in order to set the surface resistance Rs thereof to a desired value. If the charge preventive film is made excessively thin, this thin film takes an island shape so that the resistance is unstable and the film reproductivity becomes poor, although they depend on the surface energy of material of the charge preventive film, a tight contactness with a base member, and a base member temperature.

It is therefore preferable to use semiconductive material whose specific resistance value is larger than metal conductor and smaller than insulating material. Such material often has a negative resistance temperature coefficient TCR. If TCR is negative, a temperature rise to be caused by the power consumed by the spacer surface lowers the resistance value. Therefore, new heat is generated to further raise the temperature and an excessive current flows. A so-called thermal runaway therefore occurs. If the heat generation amount or consumption power balances with the heat dissipation, the thermal runaway does. not occur. Further, if the absolute value of TCR of the charge preventive film material is small, the thermal runaway is difficult to occur.

If a charge preventive film made of material having TCR of −1% is used and the power consumption per 1 $cm^2$ of the spacer exceeds 0.1 W, current flowing through the spacer increases and a thermal runaway occurs. This has been confirmed by experiments. Although this depends on the spacer shape, a voltage Va (V) applied across the spacer, and TCR of the charge preventive film, the Rs value is $10\times Va^2$ Ω/square or larger in order to suppress the consumption power lower than 0.1 W per 1 $cm^2$. Namely, it is preferable to set the sheet resistance Rs of the charge preventive film formed on the spacer in a range from $10\times Va^2$ Ω/square to $10^{11}$ Ω/square.

As described above, the thickness t of the charge preventive film formed on the insulating spacer base material is preferably 10 nm or thicker. If the film thickness t is 1 μm or thinner, a possibility of film peel-off to be caused by the film stress is very small, and the film forming process time is shortened and productivity is improved. It is therefore preferable to set the film thickness in a range from 10 nm to 1 μm, or more preferably in a range from 20 to 500 nm.

A specific resistance ρ is a product of the sheet resistance Rs and film thickness t. From the above described preferable ranges of Rs and t, it is preferable to set the specific resistance ρ of the charge preventive film in a range from $10^{-5}\times Va^2$ to $10^7$ Ωcm. More preferable, the specific resistance ρ is set in a range from $2\times10^{-5}\times Va^2$ to $5\times10^6$ Ωcm in order to realize the preferred ranges of the sheet resistance and film thickness.

The electron acceleration voltage Va of the image forming apparatus is preferably 100 V or higher, and more preferably 1 kV in order to have a sufficient luminance. If Va is 1 kV, the specific resistance of the charge preventive film is preferably in a range from 10 to $10^7$ ncm.

The present inventor has studied vigorously the charge preventive film which realizes the above-described characteristics, and found that a charge preventive-film having a heat resistant organic polymer film covering the conductive film having the above-described specific resistance value is very excellent. The charge preventive film of this invention will be described in detail in the following.

The material of the conductive film is preferably such a material which is stable and whose resistance value can be controlled in the above-described range suitable for the spacer. More preferably, the material is selected from oxide and nitride materials. Of these materials, complexes (cermet) of transition metal and ceramics such as Cr—SiO, Cr—$SiO_2$, Cr—$Al_2O_3$ and $In_2O_3$—$Al_2O_3$ and complexes of transition metal and high resistance nitride (aluminum nitride, boron nitride, aluminum nitride silicate) are particularly preferable because the resistance value can be easily adjusted and is stable during the image forming apparatus manufacture processes.

The transition metal is selected from a group of Ti, V, Cr, Mn, Fe, Co, Ni, Cu, Zt, Nb, Mo, Hf, Ta and W. These materials may be used singularly or two or more of them may be used in combination. The transition metal nitride is a metallic good conductor, whereas nitride of group III of IV typical element is an insulator. A specific resistance value of an alloy nitride film of group III or IV typical metal and transition metal can be controlled in a wide range from good conductor to insulator by adjusting the components of transition metal. Namely, the above-described specific resistance value suitable for the charge preventive film for a spacer can be realized by changing the compositions. It is known that the alloy nitride film is relatively stable material and has a small change in the resistance value during image forming apparatus manufacture processes to be described later. In addition, the resistance temperature coefficient thereof is negative and its absolute value is smaller than 1% hard to generate a thermal runaway. The heat resistance organic polymer to be coated on the conductive film is preferable a material having a small secondary electron emission factor in order to suppress generation of electric charges.

It is empirically known that the incidence electron energy $E_{om}$ (in keV unit) of organic polymer or various metals and nonorganic insulators at the maximum value $\delta_m$ of the secondary electron emission efficiency is $\delta_m$=9.5 $E_{om}$ and $E_{om}=(K/12.09)^{0.580}$ where K is a constant unique to substance (refer to E. A. Burke, IEEE Trans. on Nuclear Sci., NS-27, 1760 (1980)). In general, the value K lowers as the structure of repetitive units of organic polymer becomes more complicated. The value K is quantitatively expressed by K=10.64 (N/M)−3.15 where N is a valence electron number of monomer (N=1, 3, 4 and 5 for H, C, N and O) and M is a monomer molecular amount. For example, teflon has K=1.55 ((NIM)=0.44), kapton (polyimide) has K=0.68 ((N/M)=0.360), and celazole (polybenzimidazole) has K=0.72 ((N/M)=0.364).

Therefore, the heat resistant organic polymer film covering an alloy nitride film preferably has as small a ratio (N/M) of the valence electron number N and molecular amount M of monomer as possible, and the preferable range is (N/M) $\leqq$0.4.

A heat resistance organic polymer film of polyimide or polybenzimidazole has a thickness of the surface charge layer due to secondary electron emission of 400 to 1000 angstroms. From the viewpoint of suppression of charge amount and conductivity acquisition of this invention, the preferred range of a film thickness is from 10 to 500 angstroms.

The conductive film of the invention can be formed on an insulating member by thin film forming methods such as sputtering, reactive sputtering, electron beam vapor deposition, ion plating, ion assisted vapor deposition, CVD, and alkoxide methods.

The material of the conductive film is preferably such a material which is thermally stable and whose resistance does not dependent upon an ambient atmosphere. The spacer of the invention has the conductive film covered with the heat resistant organic polymer film, so that the atmosphere during the processes of manufacturing the image forming apparatus does not directly affect the spacer. Therefore, the material can be selected be taking into consideration not only the material characteristics but also the merits on material cost and manufacture processes.

The heat resistant organic polymer film of this invention can be formed on an alloy nitride film by thin film forming methods such as sputtering, dipping, spin coating, Langmuir-Blodgett's method, organic molecular beam epitaxy (OMBE), and vapor deposition polymerization methods.

The charge preventive film for a spacer of the image forming apparatus has been described above. However, since the charge preventive film obtained by coating the conductive film with a heat resistant organic polymer film has a very excellent charge preventing ability, it may be very effectively used for other applications different from the spacer of an image forming apparatus.

The image forming apparatus of the invention will be described in the following with reference to preferred configurations.

FIG. 1 is a schematic cross sectional view of an image forming apparatus according to a configuration embodiment of the invention, showing mainly a spacer 10. Referring to FIG. 1, reference numeral 1 represents a number of fine electron emitting elements, reference numeral 13 represents an electron source substrate, reference numeral 2 represents a rear plate, and reference numeral 3 represents a side wall. Reference numeral 4 represents a glass substrate formed with a fluorescent film 5, and reference. numeral 6 represents a metal back, these elements constituting a face plate 7. The rear plate 2, side wall 3 and face plate 7 constitute an air-tight container (envelope) 8 which maintains vacuum the inside of the display panel.

An electron emitting element may be a cold cathode element capable of being mounted at a high density, such as field emission type electron emitting elements which emit electrons from a conical or needle-like tip and surface conduction type electron emitting elements. Reference numeral 9 represents an X-direction wiring, and reference numeral 10 represents a spacer. In FIG. 1, wirings for driving the electron source are omitted.

The spacer 10 has an Na block layer 10*b* on the surface of an insulating base member 10*a,* and a charge preventive film 10*e* formed on the Na block layer 10*b*. The charge preventive film 10*e* has a semiconductive film 10*c* made of an alloy nitride film of group III or IV typical element and transition metal and an insulating film 10*d* made of heat resistant organic polymer. In this configuration, the Na block layer 10*b* is formed if necessary. The spacer 10 is provided in order to prevent breakage or deformation of the vacuum envelope 8 to be caused by atmospheric pressure applied thereto. The material, shape, layout, and number of spacers 10 are determined by taking into consideration the shape, thermal expansion coefficient and the like of the envelope 8, and the atmospheric pressure, heat and the like to be applied to the envelope 8. The shape of the spacer may be a flat plate type, a cross type, an L-character type, or the like. The spacer 10 operates more effectively as the image forming apparatus becomes large.

In order to be resistant to the atmospheric pressure applied to the face plate 7 and rear plate 2, the material of the insulating base member 10*a* preferably has a high mechanical strength and high heat resistance, such as glass and ceramics. If glass is used as the face plate and rear plate, the insulating base material 10*a* is preferably made of glass or other material having the same thermal expansion coefficient in order to suppress thermal stress during manufacture steps of the image forming apparatus.

If the insulating base member 10*a* is made of glass which contains alkali ions, such as soda glass, there is a possibility that the conductivity of the charge preventive film 10*e* is changed by, for example, Na ions. Invasion of alkali ions such as Na ions into the charge preventive film can be suppressed by inserting if necessary the Na block layer 10*b* made of silicon nitride, aluminum oxide or the like between the insulating base member and charge preventive film.

The semiconductive film of the alloy nitride film 10*c* is made of group III or IV typical element and transition metal. The group III or IV typical element may be Al, Si or B and the transition metal may be Cr or W, and a combination of these elements may be used.

The insulating film 10*d* of heat resistant organic polymer may be made of polyimide or polybenzimidazole.

The potential of the spacer 10 is defined by electrically connecting the spacer 10 to the metal back 6 and X-direction wiring 9, and a voltage generally equal to an acceleration voltage Va is applied between opposite ends of the spacer 10. In this configuration, although the spacer is connected to the X-direction wiring, it may be connected to another dedicated electrode to define its potential. If there is the structure that an intermediate electrode plate (grid plate or the like) is provided between the face plate 7 and rear plate 2 in order to shape an electron beam or prevent charge of the substrate insulating portion, the spacer may be passed through the intermediate electrode plate in an electrically insulated state, and connected to another potential defining means via the intermediate electrode plate.

If electrodes 11 of good conductive material such as Al and Au are formed on opposite sides of the spacer, good electrical connection between the charge preventive film and electrodes on the face plate and rear plate can be established.

Figure 2:
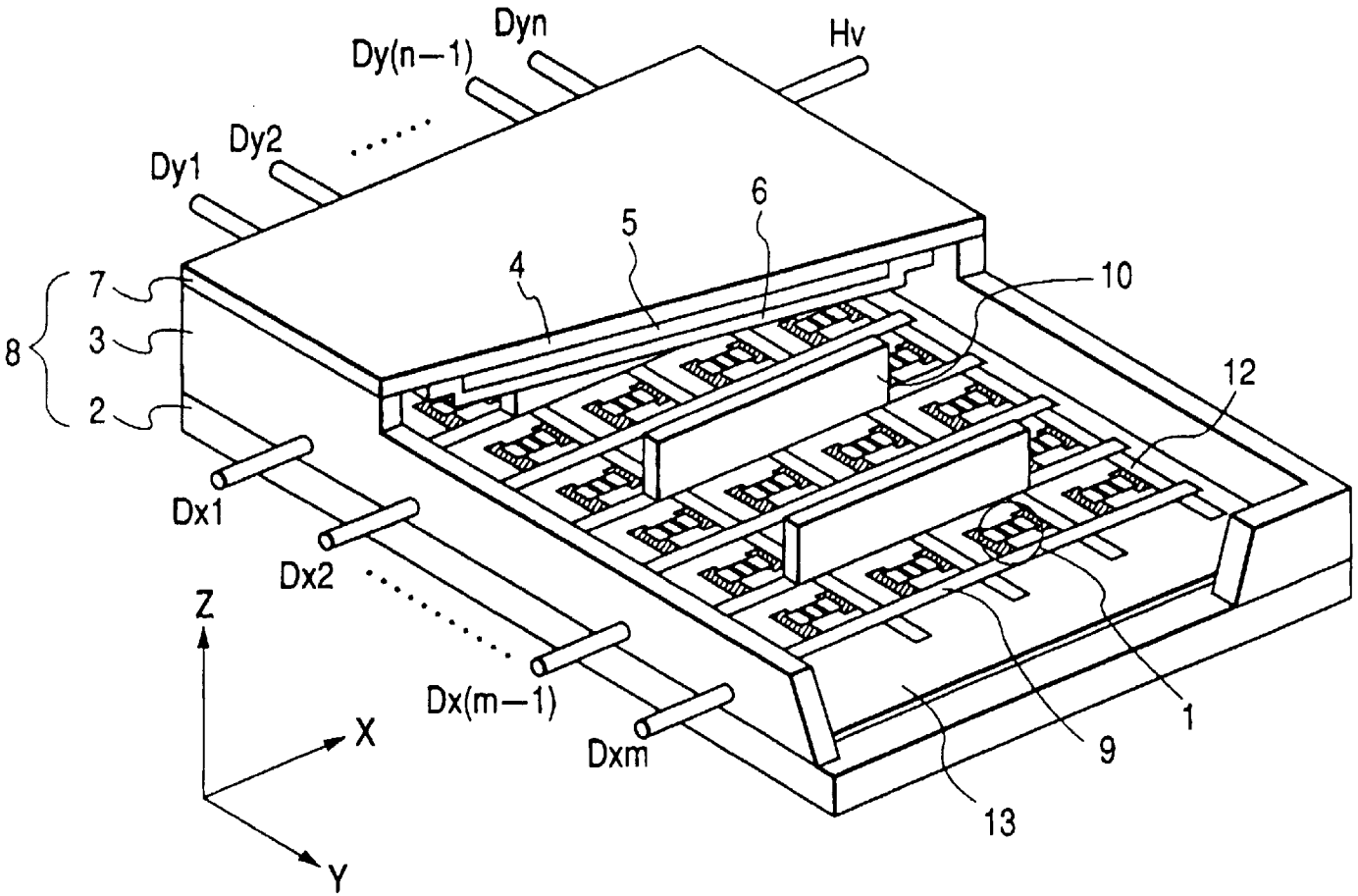
FIG. 2 is a perspective view of an image forming apparatus of the invention, with a portion of the display panel being broken.

Next, an image forming apparatus using spacers described above will be described. FIG. 2 is a perspective view of a display panel used with an embodiment to be described later, a portion of the panel being broken in order to show the internal structure.

In FIG. 2, reference numeral 2 represents a rear plate, reference numeral 3 represents a side wall, and reference numeral 7 represents a face plate. The rear plate 2, side wall 3 and face plate 7 constitute an air-tight container (envelope) which maintains vacuum the inside of the display panel. In assembling the air-tight envelope, a connection area between respective components is required to be hermetically adhered in order to provide the connection area with sufficient strength and air-tightness. Such hermetical adhesion is achieved by coating the connection area with, for example, frit glass, and baking the glass in the atmospheric air or in a nitrogen atmosphere for 10 minutes or longer at 400 to 500° C. A method of evacuating the inside of the air-tight envelope will be later described.

A substrate 13 is fixed to the rear plate 2. N×M cold cathode elements 1 are formed on the substrate. N and M are positive integers of 2 or larger and are properly set in accordance with a target number of display pixels. If the image forming apparatus is used for a high definition TV, it is preferable to set N=3000 and M=1000 or more. The N×M cold cathode elements 1 are wired in a simple matrix form by M X-direction wirings 9 and N Y-direction wirings 12. A structure made of the substrate 13, cold cathode elements 1, X-direction wirings 9, and Y-direction wirings 12 is the electron source. The manufacture method and structure of the electron source will be later described.

In this configuration, although the substrate of the electron source is fixed to the rear plate 2 of the air-tight envelope 2, the substrate 13 itself of the electron source may be used as the rear plate 2 of the air-tight envelope if the substrate 13 of the electron source has a sufficient mechanical strength.

Figure 3A:
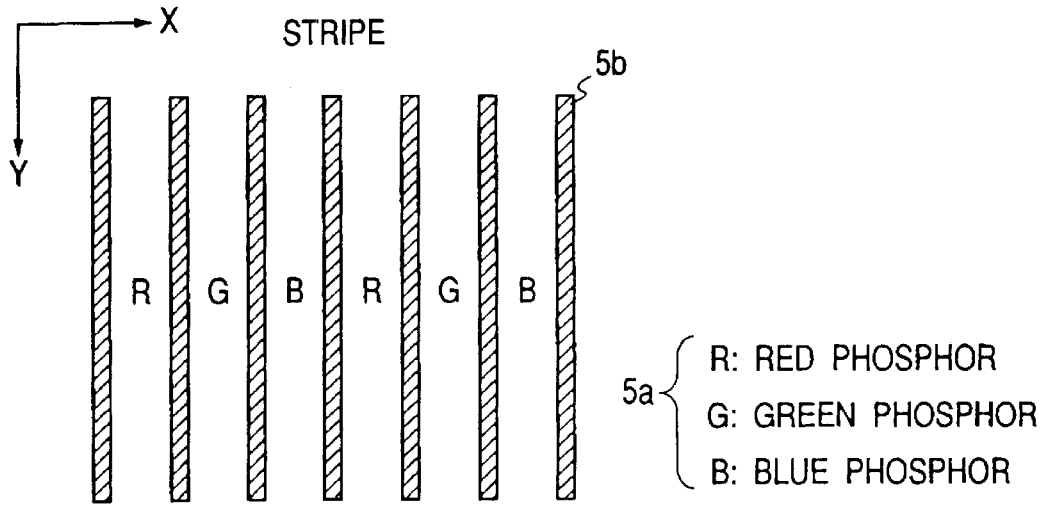
FIGS. 3A and 3B are plan views showing a layout of fluorescent materials of a face plate of the display panel.

An image forming member made of the fluorescent film 5 and metal back 6 is formed on the bottom surface of the face place 7. In this configuration, since the apparatus is a color image forming apparatus, the fluorescent materials of red, green and blue colors of three primary colors used in the field of CRT are divisionally coated. The fluorescent material of each color is coated, for example, in stripe shapes such as shown in FIG. 3A, and black color conductive material 5*b* is coated between fluorescent material stripes. An object of the black color conductive material 5*b* is to prevent a display color shift even if there is some displacement of a radiation position of an electron beam, to prevent external light reflection to thereby avoid a lower display contrast, to prevent charge-up of the fluorescent film 5 to be caused by electron beams, and for other purposes. Although the black color conductive material 5*b* has black lead as its main composition, other materials may also be used if the above-described objects can be achieved.

Figure 3B:
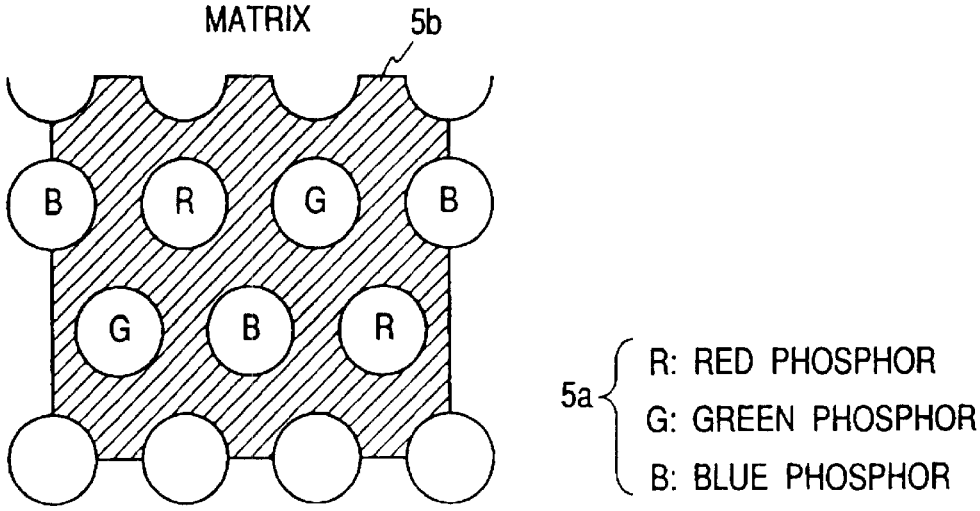

The coating of fluorescent materials of three primary colors is not limited only to the stripe layout shown in FIG. 3A. For example, a delta layout shown in FIG. 3B and other layouts may also be used.

If a monochrome display panel is to be formed, the black color conductive material is not necessarily used, but a monochrome fluorescent material used as the fluorescent film 5.

The metal back 6 well known in the CRT technical field is formed on the fluorescent film 5 on the side of the rear plate. An object of the metal back 6 is to improve a light use efficiency by mirror-reflecting a portion of light emitted from the fluorescent film 5, to protect the fluorescent film 5 from negative ion impacts, to use it as an electrode for applying an electron beam acceleration voltage, to use it as a conductive path of electrons which excited the fluorescent film 5, and for other purposes. The metal back 6 was formed by forming the fluorescent film 5 on the face plate substrate 4, thereafter planarizing the surface of the fluorescent film 5, and vacuum depositing Al on the surface of the fluorescent film 5. If the fluorescent film 5 is made of low voltage fluorescent materials, the metal back 6 may not be used as the image forming member.

Although not used in this configuration, a transparent electrode made of, for example, ITO, may be formed between the face plate substrate 4 and fluorescent film 5 in order to apply an acceleration voltage or improve the conductivity of the fluorescent film.

Dx1 to Dxm, Dy1 to Dyn, and Hv are electrical connection terminals of an air-tight structure for electrically connecting the display panel to an unrepresented electric circuit. Dx1 to Dxm are electrically connected to the X-direction wirings of the electron source, Dy1 to Dyn are electrically connected to the Y-direction wirings of the electron source, and Hv is electrically connected to the metal back 6 of the face plate 7.

The inside of the air-tight envelope is evacuated to a vacuum degree of about $10^{-7}$ Torr, by using an unrepresented exhaust pipe and vacuum pump after the air-tight envelope is assembled. Thereafter, the exhaust pipe is sealed. In order to maintain the vacuum degree of the air-tight envelope, a getter film (not shown) is formed at a predetermined position of the inside of the air-tight envelope immediately before or after the exhaust pipe is sealed. The getter film is formed by heating getter material having Ba as its main component with a heater or through high frequency heating to vapor deposit it. The absorption function of the getter film maintains the inside of the air-tight envelope at a vacuum degree of $1\times10^{-5}$ to $1\times10^{-7}$ Torr.

An example of the fundamental structure of the image forming apparatus of the invention has been described with reference to the preferred configuration.

Next, a method of manufacturing an electron source to be used by the image forming apparatus of the above-described configuration will be described. The material and shape of each cold cathode element and its manufacture method are not limited so long as the electron source to be used by the image forming apparatus of the above-described configuration is an electron source wired by a simple matrix form. Therefore, other cold cathode elements such as surface conduction type emitting elements, FE type elements and MIM type elements may also be used.

Of these cold cathode elements, a surface conduction type emitting element is particularly suitable because the present environment requests for an image forming apparatus having a large display screen and being inexpensive. More specifically, the electron emission characteristics of an FE type element are greatly influenced by the relative position and shapes of the emitter cone and gate electrode. Therefore, manufacture techniques with very high precision are necessary, which is disadvantageous factors in realizing a large display screen and a manufacture cost reduction. An MIM type element is required to form a thin and uniform insulating film and upper electrode, which is disadvantageous factors in realizing a large display screen and a manufacture cost reduction.

In contrast, the surface conduction type emitting element requires a relatively simple manufacture method and is easy to realize a large display screen and a manufacture cost reduction.

Next, the preferred fundamental structure, manufacture method and characteristics of a surface conduction type electron emitting element will be described and then the structure of an electron source having a number of elements wired in a simple matrix form will be described.

(Preferred Element Structure and Manufacture Method of Surface Conduction Type Emitting Element)

Typical structures of a surface conduction type emitting element include two types, a horizontal type and a vertical type.

(Horizontal Type Surface Conduction Type Emitting Element)

First, the structure and manufacture method of a horizontal type surface conduction type emitting element will be described.

Figure 4A:
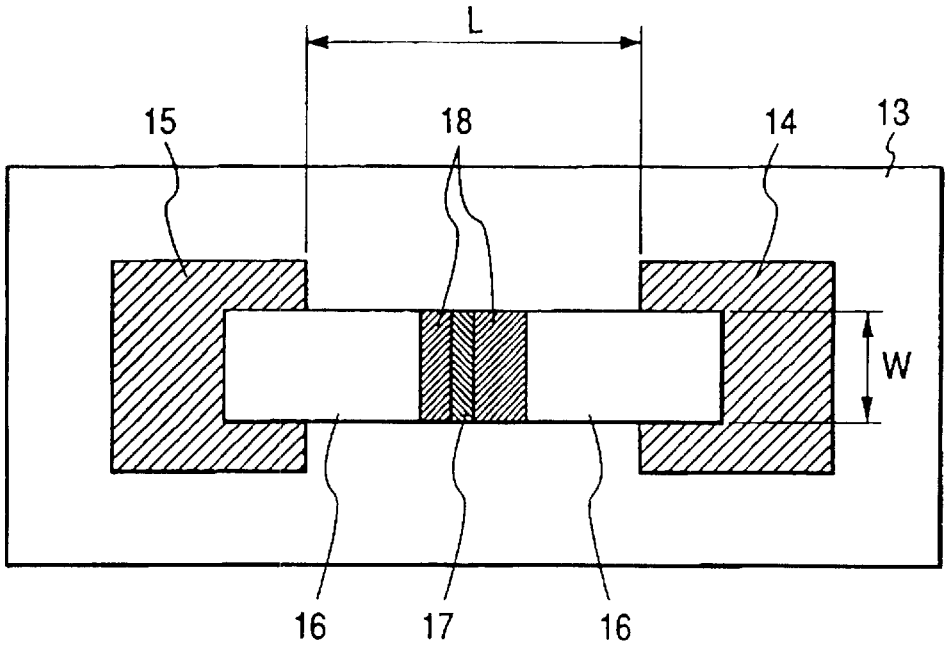
FIGS. 4A and 4B are a schematic plan view and a schematic cross sectional view showing the structure of a horizontal type surface conduction electron emitting element.
Figure 4B:
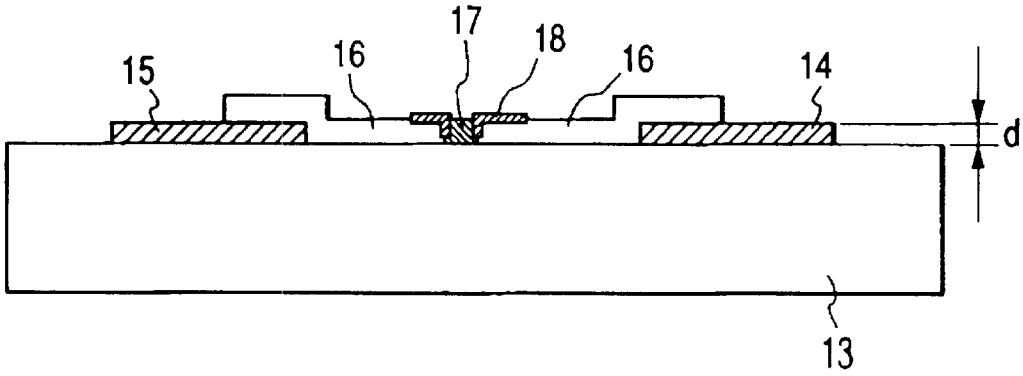

FIG. 4A is a plan view showing the structure of a horizontal type surface conduction type emitting element, and FIG. 4B is a cross sectional view of the element. In FIGS. 4A and 4B, reference numeral 13 represents a substrate, reference numerals 14 and 15 represent element electrodes, reference numeral 16 represents a conductive thin film, reference numeral 17 represents an electron emission area formed by an electric energization forming process, and reference numeral 18 represents a thin film formed by an electric energization activation process.

The substrate 13 may be made of various types of glass substrates such as quartz glass and soda-lime glass, of various types of ceramic substrates such as alumina, and of these substrates laminated with an insulating film made of $SiO_2$.

The element electrodes 14 and 15 facing each other and formed on the substrate 13 in parallel to the substrate surface are made of conductive material. The material may be any material selected from a group consisting of: metals such as Ni, Cr, Au, Mo, W, Pt, Ti, Cu, Pd, Ag, or alloys thereof; metal oxide such as $In_2O_3$, $SnO_2$; and semiconductor such as polysilicon. The electrode can be easily formed by a combination of, for example, film forming techniques such as vacuum vapor deposition and patterning techniques such as photolithography and etching. Other methods such as printing techniques may also be used.

The shape of the element electrodes 14 and 15 is designed in accordance with the technical field of application of the electron emitting element. The electrode space L is generally designed in a range from several ten nm to several ten $\mu$m, or in a range from several $\mu$m to several ten $\mu$m preferable for the application to an image forming apparatus. A thickness d of the element electrode is designed in a range from several ten nm to several $\mu$m.

The conductive thin film 16 is made of a fine particle film. The fine particle film is intended to mean a film (including a collection of island particles) containing a number of fine particles as constituent elements. From a microscopic observation of the fine particle film, the film has generally the structure of fine particles disposed spaced apart from each other, the structure of fine particles disposed near each other, or the structure of fine particles superposed each other.

The diameter of a fine particle of the fine particle film is in the range from several tenth nm to several hundred nm, or preferably in the range from 1 nm to 20 nm. The thickness of a fine particle film is set as desired by taking into consideration the various conditions: the conditions that the fine particle film can be electrically connected to the element electrodes 14 and 15 in a good state; the conditions that the electric energization forming process to be described later can be properly executed; the conditions that the electrical resistance of the fine particle film can be set to a proper value; and other conditions. The diameter of a fine particle is set in the range from several tenth nm to several hundred nm, or preferably in the range from 1 nm to 50 nm.

The material of the fine particle film may be any material selected from a group consisting of: metals such as Pd, Pt, Ru, Ag, Au, Ti, In, Cu, Cr, Fe, Zn, Sn, Ta, W, and Pb; oxides such as PdO, Sn, $SnO_2$, $In_2O_3$, PbO, and $Sb_2O_3$; borides such as $HfB_2$, $ZrB_2$, $LaB_6$, $CeB_6$, $YB_4$, and $GdB_4$; carbides such as TiC, ZrC, HfC, TaC, SiC, and WC; nitrides such as TiN, ZrN, and HfN; semiconductors such as Si and Ge; and carbon.

As described above, the sheet resistance of the fine particle film of the conductive thin film 16 was set in the range from $10^3$ to $10^7$ Ω/sq.

It is desired that the conductive thin film 16 is electrically connected to the element electrodes 14 and 15 in a proper state. The conductive thin film 16 is therefore partially superposed upon the element electrodes 14 and 15. In the example shown in FIGS. 4A and 4B, this superposition is realized by a lamination of the substrate, element electrodes, conductive thin film in this order from the bottom. The lamination may be made of the substrate, conductive thin film, and element electrodes in this order from the bottom.

The electron emission area 17 is made of cracks partially formed in the conductive thin film 16 and has an electrical resistance higher than the peripheral conductive thin film. The cracks are formed in the conductive thin film 16 by the electric energization forming process to be described later. Fine particles having a diameter of several tens nm to several ten nm are disposed in some cases in the cracks. Since it is difficult to precisely and correctly draw the position and shape of the electron emission area, these are schematically shown in FIGS. 4A and 4B.

The thin film 18 is made of carbon or carbon compound and covers the electron emission area 17 and its nearby area. The thin film 18 is formed by the electric energization activation process to the described later after the electric energization forming process is executed.

The thin film 18 is made of single crystal graphite, polysilicon graphite or amorphous carbon, or their mixture. The thickness of the thin film 18 is preferably set to 50 nm or thinner, or more preferably 30 nm or thinner.

Since it is difficult to precisely draw the position and shape of the thin film 18, these are schematically shown in FIGS. 4A and 4B. In the plan view of FIG. 4A, the element with a portion of the thin film 18 being removed is shown.

The preferred fundamental structure of the element has been described. In the embodiment, the following element were used.

The substrate 13 was made of soda lime glass, the element electrodes 14 and 15 were made of a Pt thin film. The thickness d of the element electrode was set to 100 nm, and the space L between the electrodes was set to 2 $\mu$m. The main components of the fine particle film were Pd or PdO, the thickness of the fine particle film was set to about 10 nm and the width W thereof was set to 10 nm.

Next, a preferred method of manufacturing a horizontal type surface conduction type emitting element will be described.

FIGS. 5A to 5D are cross sectional views illustrating the processes of manufacturing a surface conduction type emitting element, the elements thereof being represented by identical reference numerals to those used in FIGS. 4A and 4B.

Figure 5A:
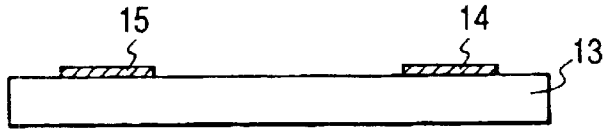
FIGS. 5A, 5B, 5C, 5D and 5E are cross sectional views illustrating the processes of manufacturing a horizontal type surface conduction emitting element.

(1) First, as shown in FIG. 5A, element electrodes 14 and 15 are formed on a substrate 13.

In forming the element electrodes 14 and 15, the substrate 13 is first cleaned sufficiently with cleaning agent, pure water and organic solvent. Thereafter, material of the element electrode is deposited through, for example, vacuum film forming techniques such as vapor deposition and sputtering. Thereafter, the deposited electrode material is patterned through photolithography/etching techniques to form a pair of element electrodes 14 and 15 shown in FIG. 5A.

Figure 5B:
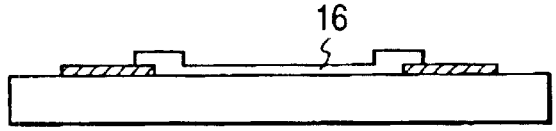

(2) Next, a conductive thin film 16 is formed as shown in FIG. 5B.

In forming the conductive thin film 16, organic metal solution is coated on the surface of the substrate shown in FIG. 5A and heated and baked to form a fine particle film. This fine particle film is patterned into a predetermined shape through photolithography/etching. The organic metal solution is a solution of organic metal compound having as its main components fine particle material of the conductive thin film. In this example, Pd was used as the main components. Also in this example, the organic metal solution was coated by a dipping method. Other methods such as a spinner method and a spray method may also be used.

As a method of forming the conductive thin film made of a fine particle film, instead of coating the organic metal solution as in the example, vacuum vapor deposition, sputtering, or chemical vapor deposition may also be used.

Figure 5C:
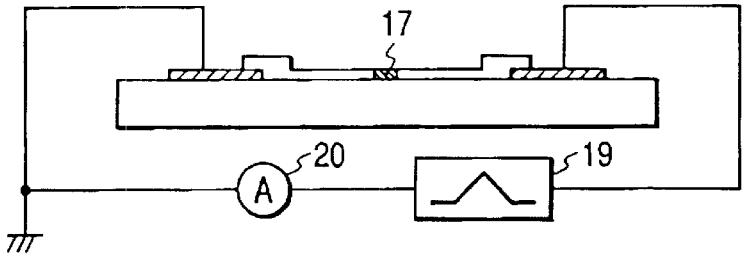

(3) Next, as shown in FIG. 5C, an electric energization forming process is executed to form an electron emission area 17, by applying a proper voltage between the element electrodes 14 and 15 from a forming power source 19.

The electric energization forming process is a process of electrically energizing the conductive thin film 16 made of a fine particle film to partially destroy, deform or decompose the conductive thin film and transform the structure of the film into a structure suitable for electron emission. The structure of the conductive thin film made of a fine particle film transformed suitable for electron emission (i.e., electron emission area 17) is formed with proper cracks. As compared to the state before the electron emission area 17 is formed, the electrical resistance between the element electrodes 14 and 15 measured after the electron emission area 17 is formed increases considerably.

Figure 6:
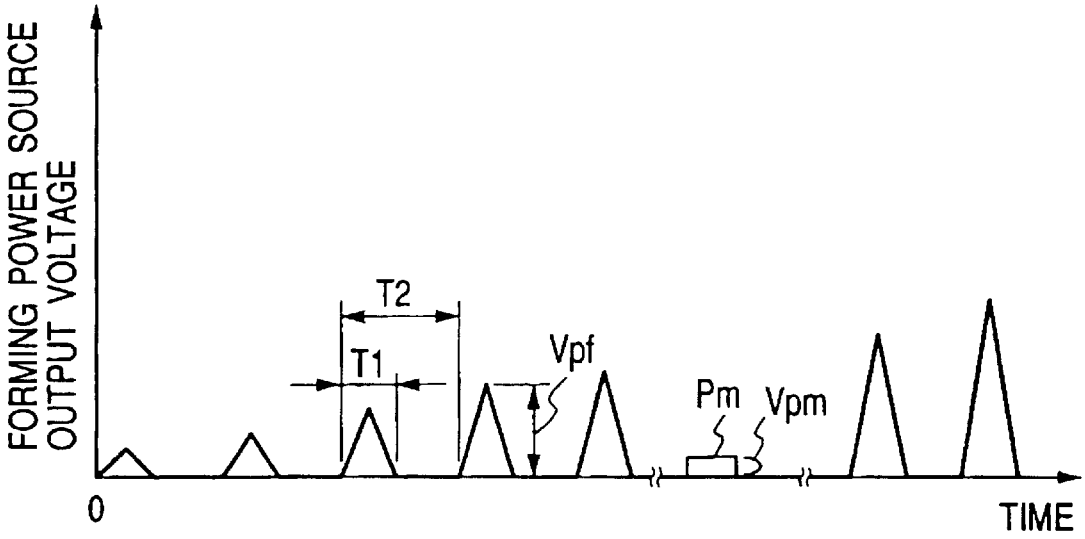
FIG. 6 is a graph showing the waveforms of an application voltage pulse used for an electric energization forming process.

Examples of proper waveforms of a voltage to be applied from the forming power source 19 are shown in FIG. 6 in order to describe the electric energization forming process in more detail. A voltage used for the forming process of the conductive thin film made of a fine particle is preferably a pulse voltage. As shown in FIG. 6, in this example, triangular pulses having a pulse width T1 were applied consecutively at a pulse interval of T2. In this case, the peak value Vpf of the triangular pulse was gradually raised. Monitor pulses Pm for monitoring the forming state of the electron emission area 17 were inserted between the triangular pulses at a proper interval, and current was measured with an ammeter 20.

In this example, for example, the electric energization forming process was executed under the conditions of a vacuum atmosphere of about $10^{-5}$ Torr, a pulse width T1 of 1 msec, a pulse interval T2 of 10 msec, and a peak voltage Vps rise of 0.1 V per one pulse. The monitor pulse Pm was inserted each time five triangular pulses were applied. In order to adversely affect the forming process, a voltage Vpm of the monitor pulse was set to 0.1 V. When the electrical resistance between the element electrodes 14 and 15 took $1\times10^{6}$ Ω, i.e., when the current of the monitor pulse measured with the ammeter 20 took $1\times10^{-7}$ A or smaller, the electric energization forming process was terminated.

This method is a preferable method of forming a surface conduction type emitting element. If the design of a surface conduction type emitting element is changed, for example, if the material and thickness of the fine particle film and the element electrode space L are changed, it is preferable to properly change the conditions of the electric energization forming process.

Figure 5D:
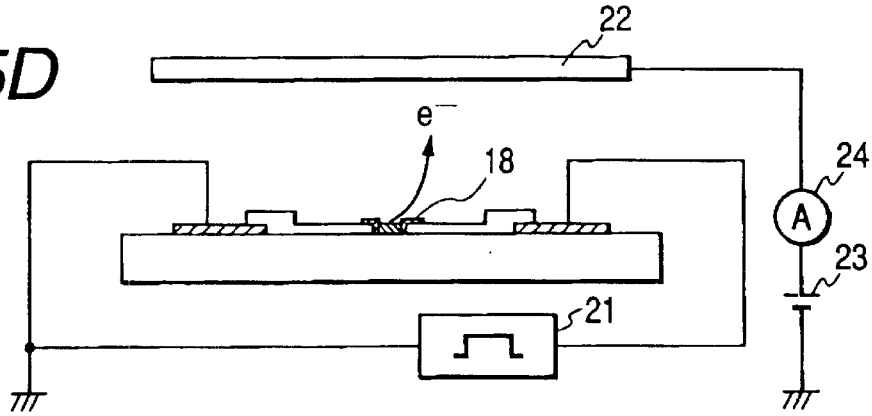

(4) Next, as shown in FIG. 5D, the electric energization activation process is executed to improve the electron emission characteristics, by applying a proper voltage between the element electrodes 14 and 15 from an activation power source 21.

The electric energization process is a process of depositing carbon or carbon compound on an area near the electron emission area 17, by electrically energizing the electron emission area 17 formed by the electric energization forming process. In FIG. 5D, deposits of carbon or carbon compound are schematically shown as a member 18. The emission current at the same application voltage was able to be increased typically by 100 times as compared with the current measured before the electric energization activation process.

More specifically, voltage pulses were periodically applied in a vacuum atmosphere in the range from $10^{-4}$ to $10^{-5}$ Torr to deposit carbon or carbon compounds by using organic compounds in the vacuum atmosphere as source materials. The deposits 18 are made of single crystal graphite, polysilicon graphite, or amorphous carbon or their mixture. The film thickness is 50 nm or thinner, or more preferably 30 nm or thinner.

Figure 7A:
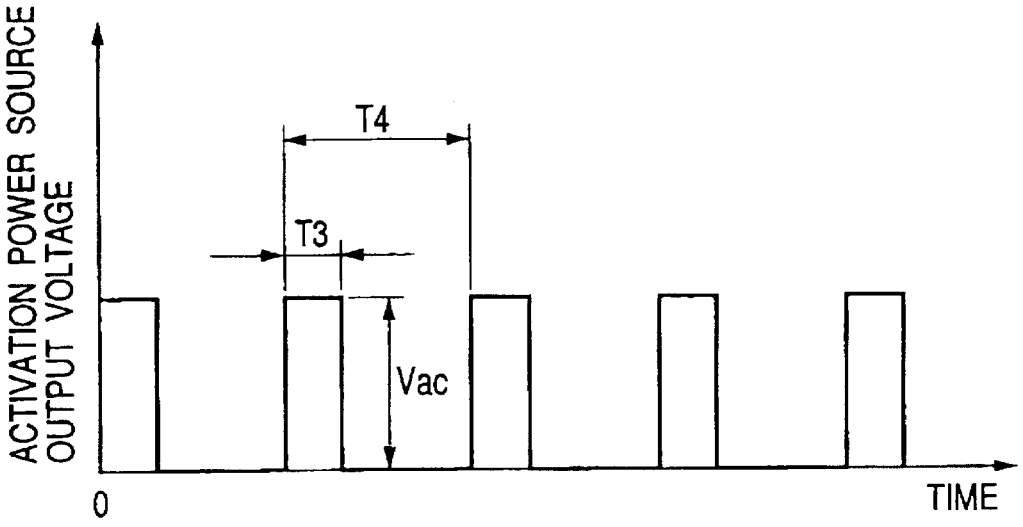
FIG. 7A is a diagram showing the waveforms of an application voltage pulse used for an electric energization activation process.

Examples of proper waveforms of a voltage to be applied from the activation power source 21 are shown in FIG. 7A in order to describe the electric energization activation process in more detail. In this example, the electric energization process was executed by periodically applying a rectangular pulse having a constant voltage. More specifically, a voltage Vas of the rectangular pulse was set to 14 V, a pulse width T3 was set to 1 msec, and a pulse interval T4 was set to 10 msec. This method is a preferable method of forming a surface conduction type emitting element. If the design of a surface conduction type emitting element is changed, it is preferable to properly change the conditions of the electric energization activation process.

Figure 7B:
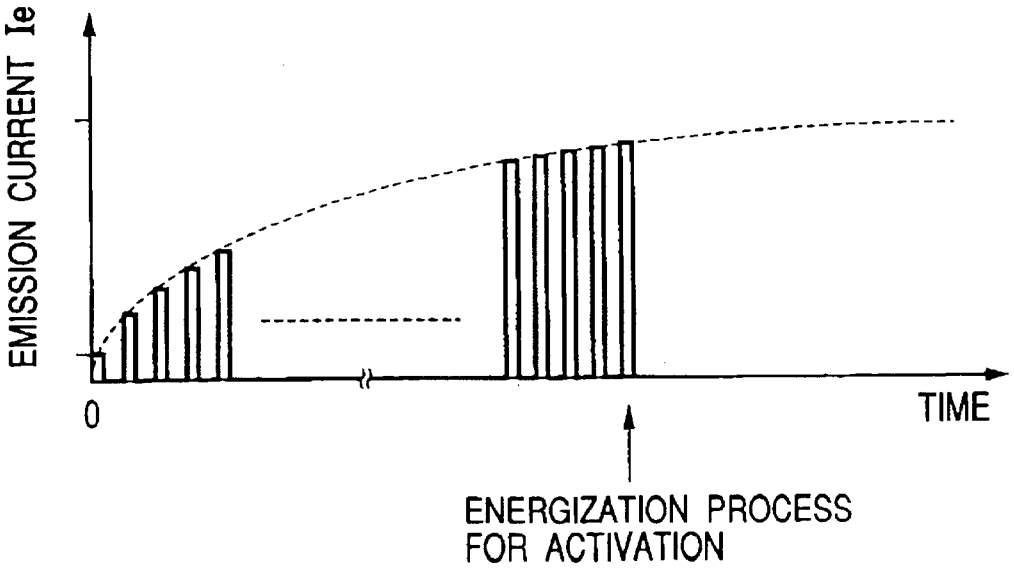
FIG. 7B is a graph showing a change in an emission current le.

Reference numeral 22 in FIG. 5D represents an anode electrode for measuring a current Ie of electrons emitted from the surface conduction type emitting element. A d.c.

high voltage source 23 and an ammeter 24 are connected to the anode electrode 22. If the activation process is executed after the substrate 13 is assembled in a display panel, the fluorescent screen of the display panel may be used as the anode electrode 22. While a voltage is applied from the activation power source 21, the emission current le is measured with the ammeter 24 to monitor a progress state of the electric energization process and control the operation of the electric energization power source 21. An example of the emission current Ie measured with the ammeter 1116 is shown in FIG. 7B. As the pulse voltage starts being applied from the activation power source 21, the emission current Ie increases as the time lapses and eventually saturates and rarely increases. When the emission current Ie becomes approximately saturated, a voltage application from the activation power source is terminated to stop the electric energization activation process.

Figure 5E:
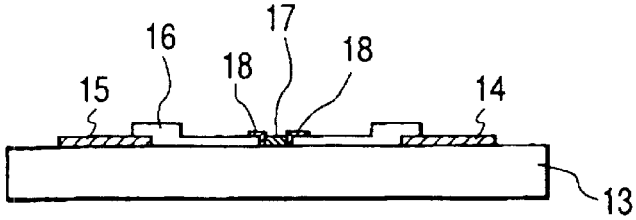

The electric energization conditions are preferable conditions of forming a surface conduction type emitting element. If the design of a surface conduction type emitting element is changed, it is preferable to properly change the conditions of the electric energization The horizontal type surface condition type emitting element shown in FIG. 5E was manufactured in the above manner.

(Vertical Type Surface Conduction Type Emitting Element)

Figure 8:
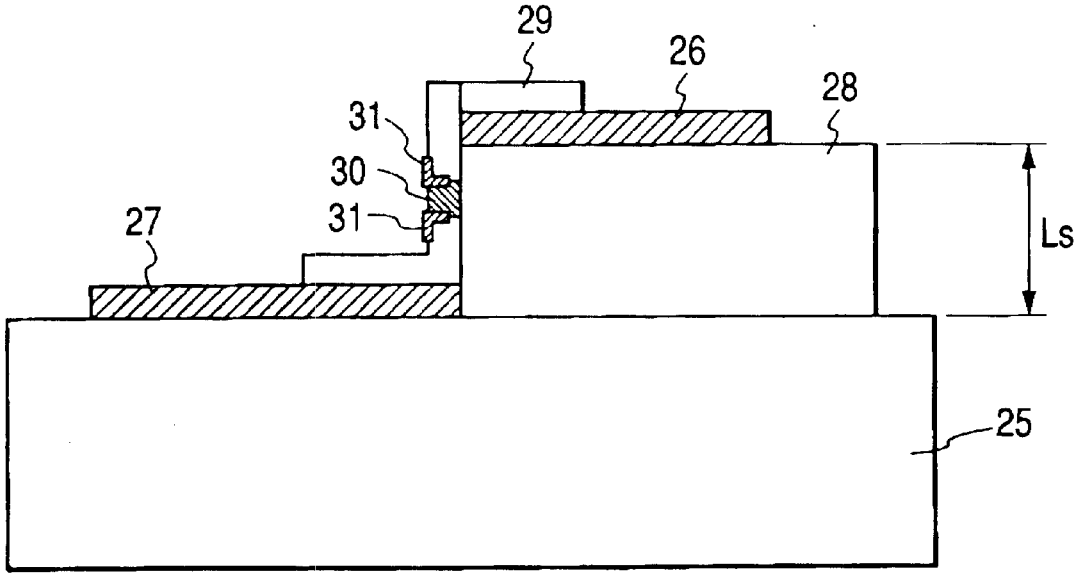
FIG. 8 is a cross sectional view of a vertical type surface conduction electron emitting element.

FIG. 8 shows another typical structure of the surface conduction type emitting element having a fine particle film formed in the electron emission area and its nearby area, i.e., the structure of a vertical type surface conduction type emitting element. FIG. 8 is a schematic cross sectional view showing the fundamental structure of a vertical type surface conduction emitting element. In FIG. 8, reference numeral 25 represents a substrate, reference numerals 26 and 27 represent element electrodes, reference numeral 28 represents a step forming member, reference numeral 29 represents a conductive thin film made of a fine particle film, reference numeral 30 represents an electron emission area formed by an electric energization forming process, and reference numeral 31 represents a thin film formed by an electric energization activation process.

Different points of the vertical type element from the horizontal type element described earlier are that one of the element electrodes 26 is formed on the step forming member 28 and the conductive thin film 29 covers the side of the step forming member 28. Therefore, the element electrode space L of the horizontal element shown in FIGS. 4A and 4B is defined in the vertical type element as a step height Ls of the step forming member 28. The materials of the substrate 25, element electrodes 26 and 27 and conductive thin film 29 made of a fine particle film may use those materials of the horizontal type element described earlier. The step forming member 28 is made of electrically insulating material such as $SiO_2$.

(Characteristics of a Surface Conduction Type Emitting Element Used with an Image Forming Apparatus)

The structures and manufacture methods of horizontal and vertical type conduction emitting elements have been described above. Next, the characteristics of an element used with an image forming apparatus will be described.

Figure 9:
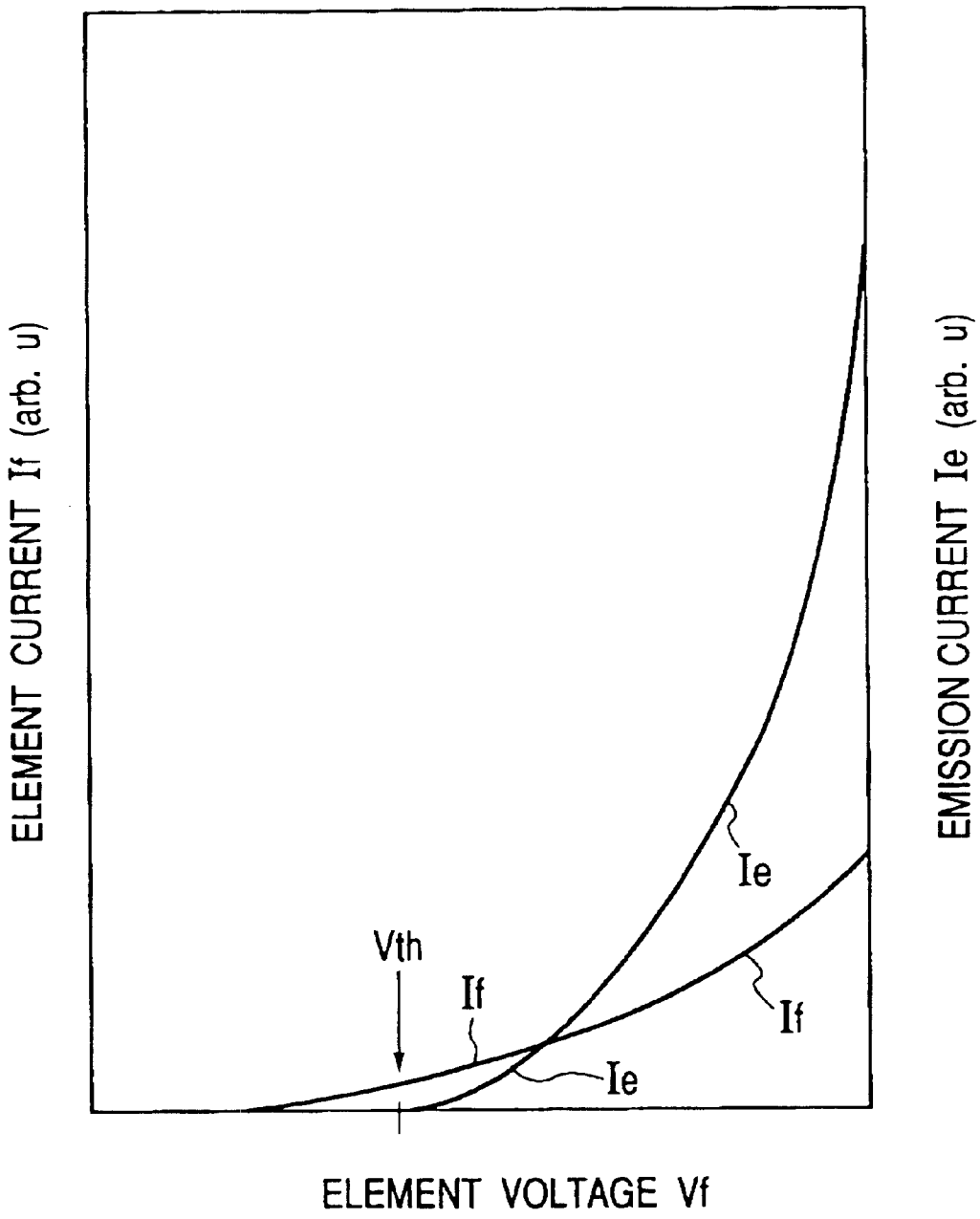
FIG. 9 is a graph showing a relation among an element voltage, an element current, an emission current of a surface conduction type electron emitting element.

FIG. 9 shows typical characteristics of (emission current Ie) relative to (element voltage Vf) and typical characteristics of (element current If) relative to (element voltage Vf) of an element used with an image forming apparatus. The emission current Ie is considerably smaller than the element current If and they are difficult to shown at the same scale. Therefore, these currents are shown at optional scales in the graph of FIG. 9.

The element used with the image forming apparatus has the following three features of the emission current Ie.

First, as a voltage higher than a certain voltage (called a threshold voltage Vth) is applied to the element, the emission current Ie increases abruptly, whereas as a voltage not higher than the threshold voltage Vth is applied, the emission current is hardly detected.

Namely, the element is a non-linear element having a definite threshold voltage Vth relative to the emission current.

Second, since the emission current Ie changes with the voltage Vf applied to the element, the amount of the emission current Ie can be controlled by the element voltage Vf.

Third, a response speed of the emission current le to the element voltage Vf is fast. It is therefore possible to control the charge amount of electrons emitted from the element in accordance with the time duration while the voltage Vf is applied.

Since a surface conduction type emitting element has the above-described features, it is possible to use it with the image forming apparatus. For example, in an image forming apparatus having a number of elements in correspondence with pixels of a display screen, an image can be displayed by sequentially scanning the display screen by utilizing the first feature. Namely, a proper voltage equal to or higher than the threshold voltage Vth corresponding to a desired pixel luminance is applied to the element to be driven, while a voltage not higher than the threshold voltage Vth is applied to elements not selected. By sequentially changing an element to be driven, it is possible to display an image by sequentially scanning the display screen.

By utilizing the second or third feature, a pixel luminance can be controlled so that a gradation display of an image is possible.

(Structure of an Electron Source with a Number of Elements Wired in a Simple Matrix Form)

Next, the structure of an electron source having a plurality of surface conduction type electron emitting elements wired in a simple matrix form will be described.

Figure 10:
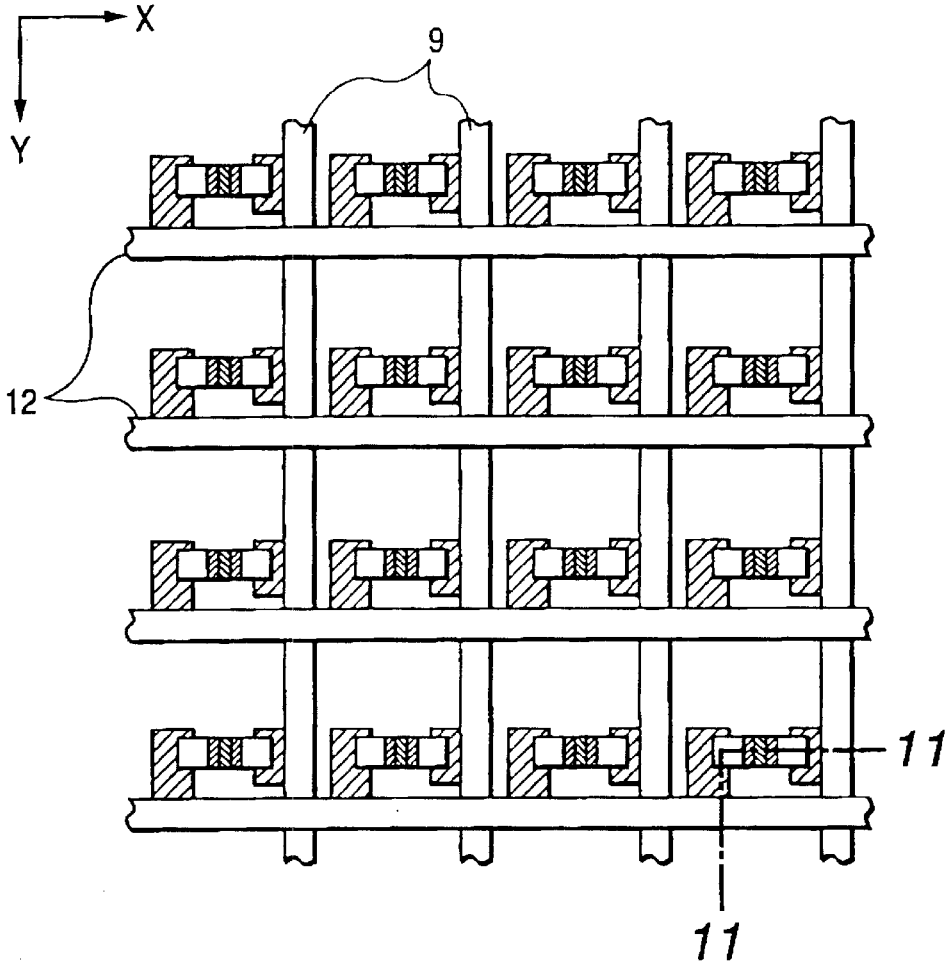
FIG. 10 is a plan view showing an electron source with electron emitting elements wired in a simple matrix form.

FIG. 10 is a plan view of an electron source having a plurality of surface conduction type electron emitting elements formed on the substrate 13, the elements being shown in FIGS. 4A and 4B and wired in a simple matrix form. On the substrate 13, surface conduction type emitting elements similar to those shown in FIGS. 4A and 4B are disposed and wired in a simple matrix form by X-direction wirings 9 and Y-direction wirings 12. At each cross area of the X-direction wirings 9 and Y-direction wirings 12, an insulating layer (not shown) is formed between the wirings to provide electrical insulation.

Figure 11:
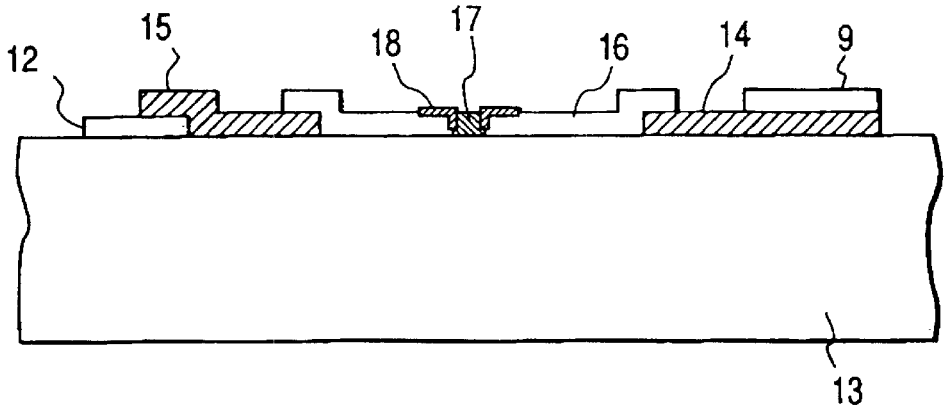
FIG. 11 is a cross sectional view taken along line 11—11 shown in FIG. 10.

FIG. 11 is a cross sectional view taken along line 11—11 of FIG. 10.

The electron source having the above-described structure was manufactured by forming the X-direction wirings 9, Y-direction wirings 12, electrode insulating layer (not shown), element electrodes 14 and 15 and a conductive thin film 16 of each surface conduction type emitting element, and thereafter supplying a power to each element via the X- and Y-direction wirings 9 and 12 to perform an electric energization forming process and an electric energization activation process.

Next, embodiments of the invention will be described.

(First Embodiment)

Figure 12:
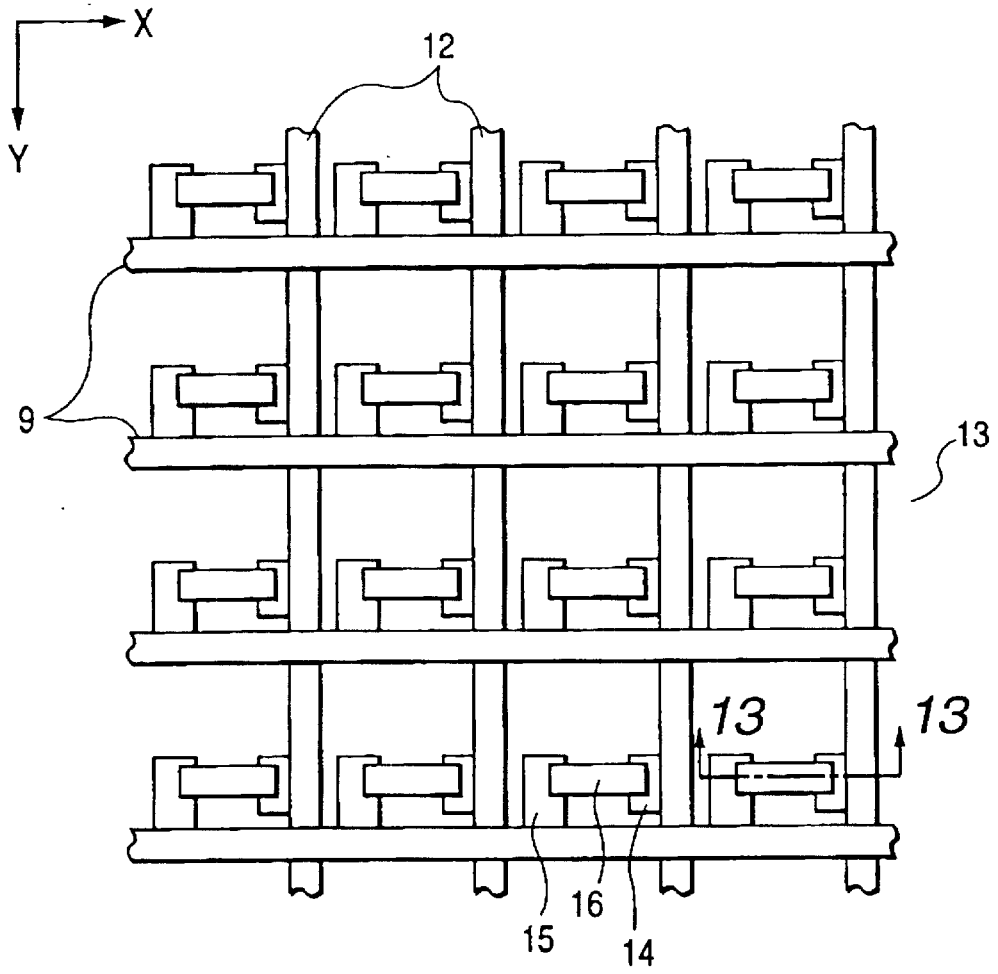
FIG. 12 is a plan view illustrating a manufacture method of an electron source of a simple matrix wired type.
Figure 13:
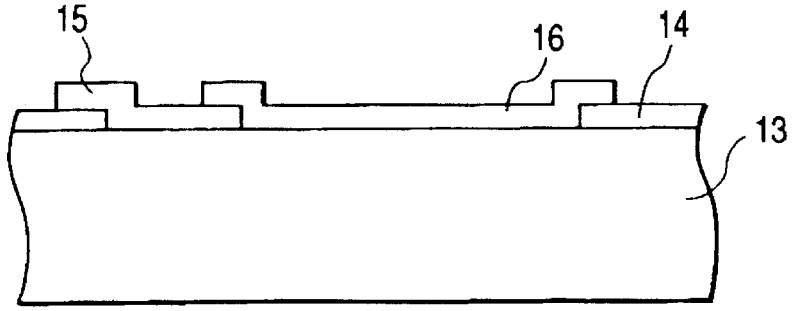
FIG. 13 is a cross sectional view taken along line 13—13 shown in FIG. 12.

In this embodiment, an image forming apparatus shown in FIGS. 1 and 2 and having as an electron source a plurality of surface conduction type electron emitting elements was manufactured. As shown in FIG. 12, on a substrate 13 made of clean soda-lime glass, a pair of element electrodes 14 and 15 and a conductive film 16 were formed in a matrix form corresponding in number to 160×720 pixels to form the surface conduction type electron emitting elements, and a plurality of X-direction (row direction) wirings 9 and a plurality of Y-direction (column direction) wirings 12 for interconnecting the plurality of surface conduction type electron emitting elements were formed. The element electrodes 14 and 15 were made of a Pt film formed by sputtering, and the X- and Y-direction wirings 9 and 12 were made of an Ag wiring formed by screen printing. The conductive film 16 was made of a PdO fine particle film formed by coating Pd amine complex solution and baked. FIG. 13 is a cross sectional view taken along line 13—13 of FIG. 12.

Figure 14:
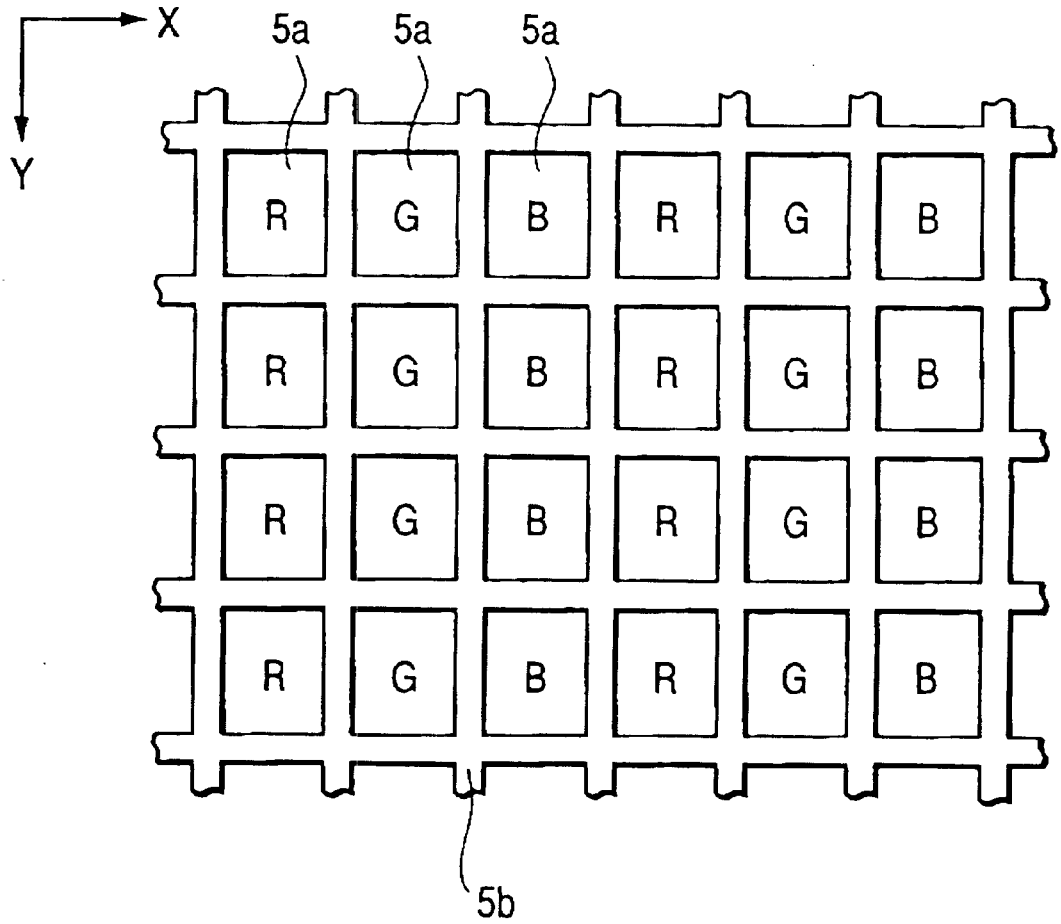
FIG. 14 is a diagram showing another layout of fluorescent materials.

As shown in FIG. 14, the fluorescent film 5 shown in FIGS. 1 and 2 was made of fluorescent materials 5*a* of respective colors in a stripe shape extending in the Y-direction, and the black conductive material 5*b* having a shape covering not only an area between the fluorescent materials 5*a* of respective colors but also an area which separates adjacent pixels in the Y-direction and in which a spacer to be described later is placed. The black conductive material 5*b* was first coated and then the fluorescent material 5*a* of each color was coated between the black conductive materials 5*b*. As the material of the black stripe, commonly used material having black lead as its main components was used. A slurry method was incorporated in order to coat the fluorescent material 5*a* of each color on the glass substrate.

As shown in FIGS. 1 and 2, the metal back 6 was disposed on the fluorescent film 5 on its inner side. The metal back 6 was formed by performing a planarizing process (usually called filming) of the inner surface of the fluorescent film and then vacuum-depositing Al, after the fluorescent film 5 was formed.

The spacer 10 shown in FIGS. 1 and 2 was formed in the following manner. On the insulating base member 10*a* (3.8 mm high, 200 μm thick, 20 mm long) made of cleaned soda-lime glass, a silicon nitride film was formed to a thickness of 0.5 μm as the Na block layer 10*b*. On the Na block layer 10*b*, a film containing elements of W, Al and N was formed through vacuum deposition as the semiconductive film 10*c*. On the semiconductive film 10*c*, the heat resistant organic polymer insulating film 10*d* made of polyimide was formed through vacuum deposition.

The semiconductive film 10*c* containing elements of W, Al and N used by this embodiment was formed by sputtering W and Al targets at the same time in an atmosphere of mixture gas of argon and nitrogen, by using a sputtering system. The compositions of the semiconductive film 10*c* were adjusted by controlling the power used for each target to obtain an optimum resistance value. The substrate was grounded and exposed at a room temperature. The semiconductive film 10*c* containing elements of W, Al and N had a film thickness of t=200 nm and a specific resistance of $\rho=2.8\times10^5$ Ωcm.

The heat resistant organic polymer insulating film 10*d* made of polyimide used by the embodiment was formed in the following manner. First, a polyimide sputtering target was formed, and this target was sputtered in an argon atmosphere by applying an RF power and using a sputtering system. The polyimide target was formed by coating varnish of polyimide (Payer ML: manufactured by I.S.T. Company Ltd.) with a spinner on an Na-free glass substrate having a diameter of 5 inches, five times under the conditions of coating and following drying at 1500 rpm and 30 sec, and thereafter curing at 350° C. to form polyimide. The thickness of a polyimide film formed on the Na-free glass substrate was 50 μm after the curing.

This polyimide target was sputtered under the conditions of an Ar pressure of 0.5 Torr and an RF power of 200 W, to form the heat resistant organic polymer insulating film 10*d* made of polyimide and having a thickness of 150 angstroms on the semiconductive film 10*c*.

As shown in FIG. 1, the Al electrodes 11 were disposed on opposite connection areas of the spacer 10 in order to obtain reliable connection to the X-direction wiring 9 and metal back 6. This electrode 11 perfectly covered the four surfaces of the spacer 10 exposed in the envelope 8, in the area from the X-direction wiring (upper surface) toward the face plate 7 by 50 μm and in the area from the metal back (surface) toward the rear plate 2 by 300 μm.

The spacers 10 were fixed to the X-direction wirings 9 at an equal pitch, the spacer 10 being manufactured as described above and having the heat resistant organic polymer insulating film 10*d* of polyimide formed on the semiconductive film 10*c* containing elements of W, Al and N.

Thereafter, the face plate 7 was disposed on the support frame 3 as shown in FIGS. 1 and 2 so as to Hdispose the face plate 7 at the position 3.8 mm higher than the electron emitting elements 1. Thereafter, the connection areas of the rear plate 2, face plate 7, support frame 3 and spacers 10 were adhered together.

The connection area between the rear plate 2 and support frame 2 and the connection area between the face plate 7 and support frame 2 were hermetically adhered by coating frit glass and baking it for 10 minutes or longer in an atmospheric air at 430° C. Each spacer 10 was fixed to the black conductive member 5*b* (300 μm in width) on the face plate 7 side by using conductive frit glass containing silica spheres each coated with Au, and in addition, electrical connection between the charge preventive film 10*e* and metal back 6 was established.

The envelope 8 completed in the above manner was evacuated by a vacuum pump via an exhaust pipe to a sufficient vacuum degree. Thereafter, a plurality of conductive films were subjected to the electric energization process (forming process) by applying a voltage between the element electrodes 14 and 15 of plurality pairs formed on the rear plate 2 shown in FIGS. 1 and 2 via the external terminals Dx1 to Dxm and Dy1 to Dyn and via the X- and Y-direction wirings 9 and 12 to form an electron emitting area in each conductive film 16. The forming process was performed by applying the voltage pulse having the waveforms shown in FIG. 6.

Next, acetone was introduced via the exhaust pipe into the envelope 8 to set the inner pressure to 1 mTorr, and voltage pulses were periodically applied to the external terminals Dx1 to Dxm and Dy1 to Dyn to thereby perform the activation process and deposit carbon or carbon compound on each conductive film 16. The activation process was performed by applying voltage pulse having the waveforms shown in FIG. 7.

Next, after the envelope 8 was evacuated for 10 hours to a vacuum degree of about $10^{-6}$ Torr while it is heated to 200° C., the exhaust pipe was heated with a gas burner and melted to hermetically seal the envelope 8.

Lastly, a getter process was executed to maintain the vacuum degree after the hermetical sealing.

In the image forming apparatus shown in FIGS. 1 and 2 and completed in the above-described manner, scan signals and modulating signals from an unrepresented signal generator means were applied to each electron emitting element 1 via the external terminals Dx1 to Dxm and Dy1 to Dyn. A high voltage was also applied via the high voltage terminal Hv to the metal back 6 to accelerate an emitted electron beam, make electrons collide with the fluorescent film 5, excite the fluorescent material, and emit light to form an image. The voltage Va applied to the high voltage terminal Hv was set to 1 to 5 kV, and the voltage Vf applied across the element electrodes 14 and 15 was set to 14 V.

In this embodiment, the resistance value of the charge preventive film le of the spacer 10 was measured after each process such as after assembly, after sealing to the face plate, after sealing to the rear plate, after vacuum evacuation, and after element electrode electric energization process. The resistance value hardly changed at each process.

Light emission spots, including those formed by emission electrons from the electron emitting elements 1 near the spacer 10, were formed at a two-dimensionally equal pitch, and an image with clear and good color reproductivity was able to be formed. This means that even if the spacers 10 were disposed, disturbance of an electric field which affects the electron trajectory was negligible. The resistance temperature coefficient of the material of the charge preventive film was −0.5% and a thermal runaway did not occur at Va=5 kV.

(Second Embodiment)

A different point of this embodiment from the first embodiment is that a film containing elements of W, B and N was used as the semiconductive film 10*c* of the spacer 10 shown in FIG. 1. An image forming apparatus shown in FIGS. 1 and 2 was manufactured in the manner similar to the first embodiment except the above-described different point.

The semiconductive film 10*c* containing elements of W, B and N used by this embodiment was formed by sputtering W and B targets at the same time in an atmosphere of mixture gas of argon and nitrogen, by using a sputtering system. The compositions of the semiconductive film 10*c* were adjusted by controlling the power used for each target to obtain an optimum resistance value. The substrate was grounded and exposed at a room temperature. The semiconductive film 10*c* containing elements of W, B and N had a film thickness of t=200 nm and a specific resistance of $\rho=2.7\times10^5$ Ωcm.

The heat resistant organic polymer insulating film 10*d* made of polyimide was formed by the method similar to the first embodiment to complete the spacer 10 of this embodiment.

In this embodiment, the resistance value of the charge preventive film 10*e* of the spacer 10 was measured after each process such as after assembly, after sealing to the face plate, after sealing to the rear plate, after vacuum evacuation, and after element electrode electric energization process. The resistance value hardly changed at each process.

Light emission spots, including those formed by emission electrons from the electron emitting elements 1 near the spacer 10, were formed at a two-dimensionally equal pitch, and an image with clear and good color reproductivity was able to be formed. This means that even if the spacers 10 were disposed, disturbance of an electric field which affects the electron trajectory was negligible. The resistance temperature coefficient of the material of the charge preventive film was −0.5% and a thermal runaway did not occur at Va=5 kV.

(Third Embodiment)

A different point of this embodiment from the first embodiment is that a heat resistant organic polymer insulating film 10*d* of the spacer 10 shown in FIG. 1 was made of polyimide (PIX-L110SX: manufactured by Hitachi Chemical Co., Ltd.). An image forming apparatus shown in FIGS. 1 and 2 was manufactured in the manner similar to the first embodiment except the above-described different point.

The semiconductive film 10*c* containing elements of W, Al and N formed by the method similar to the first embodiment had a film thickness of t=200 nm and a specific resistance of $\rho=2.8\times10^5$ Ωcm.

The heat resistant organic polymer insulating film 10*d* made of polyimide used by the embodiment was formed in the following manner. First, a polyimide sputtering target was formed, and this target was sputtered in an argon atmosphere by applying an RF power and using a sputtering system. The polyimide target was formed by coating varnish of polyimide (PIX-L110S: manufactured by Hitachi Chemical Co., Ltd.) with a spinner on an Nafree glass substrate having a diameter of 5 inches, five times under the conditions of coating and following drying at 1500 rpm and 30 sec, and thereafter curing at 350° C. to form polyimide. The thickness of a polyimide film formed on the Na-free glass substrate was 50 μm after the curing.

This polyimide target was sputtered under the conditions of an Ar pressure of 0.5 Torr and an RF power of 200 W, to form the heat resistant organic polymer insulating film 10*d* made of polyimide and having a thickness of 150 angstroms on the semiconductive film 10*c*.

In this embodiment, the charge preventive film 10*e* of the spacer 10 was measured after each process such as after assembly, after sealing to the face plate, after sealing to the rear plate, after vacuum evacuation, and after element electrode electric energization process. The resistance value hardly changed at each process.

Light emission spots, including those formed by emission electrons from the electron emitting elements 1 near the spacer 10, were formed at a two-dimensionally equal pitch, and an image with clear and good color reproductivity was able to be formed. This means that even if the spacers 10 were disposed, disturbance of an electric field which affects the electron trajectory was negligible. The resistance temperature coefficient of the material of the charge preventive film was −0.5% and a thermal runaway did not occur at Va=5 kV.

(Fourth Embodiment)

A different point of this embodiment from the third embodiment is that a film containing elements of W, B and N was used as the semiconductive film 10*c* of the spacer 10 shown in FIG. 1. An image forming apparatus shown in FIGS. 1 and 2 was manufactured in the manner similar to the third embodiment except the above-described different point.

The semiconductive film 10*c* containing elements of W, B and N used by this embodiment was formed by sputtering W and B targets at the same time in an atmosphere of mixture gas of argon and nitrogen, by using a sputtering system. The compositions of the semiconductive film 10*c* were adjusted by controlling the power used for each target to obtain an optimum resistance value. The substrate was grounded and exposed at a room temperature. The semiconductive film 10*c* containing elements of W, B and N had a film thickness of t=200 nm and a specific resistance of $\rho=2.7\times10^5$ Ωcm.

The heat resistant organic polymer insulating film 10*d* made of polyimide was formed by the method similar to the third embodiment to complete the spacer 10 of this embodiment.

In this embodiment, the resistance value of the charge preventive film 10*e* of the spacer 10 was measured after each process such as after assembly, after sealing to the face plate, after sealing to the rear plate, after vacuum evacuation, and after element electrode electric energization process. The resistance value hardly changed at each process.

Light emission spots, including those formed by emission electrons from the electron emitting elements 1 near the spacer 10, were formed at a two-dimensionally equal pitch, and an image with clear and good color reproductivity was able to be formed. This means that even if the spacers 10 were disposed, disturbance of an electric field which affects the electron trajectory was negligible. The resistance temperature coefficient of the material of the charge preventive film was −0.5% and a thermal runaway did not occur at Va=5 kV.

(Fifth Embodiment)

A different point of this embodiment from the first embodiment is that a heat resistant organic polymer insulating film 10*d* of the spacer 10 shown in FIG. 1 was made of polybenzimidazole (PBI) (Cerazole: manufactured by Hoechst Industries Co., Ltd.). An image forming apparatus shown in FIGS. 1 and 2 was manufactured in the manner similar to the first embodiment except the above-described different point.

The semiconductive film 10*c* containing elements of W, Al and N formed by the method similar to the first embodiment had a film thickness of t=200 nm and a specific resistance of $\rho=2.8\times10^5$ Ωcm.

The heat resistant organic polymer insulating film 10*d* made of polybenzimidazole (PBI) used by the embodiment was formed in the following manner. First, a PBI sputtering target was formed, and this target was sputtered in an argon atmosphere by applying an RF power and using a sputtering system. The PBI target was formed by coating varnish of polybenzimidazole (Celazole: manufactured by Hext Industries Co., Ltd.) with a spinner on an Na-free glass substrate having a diameter of 5 inches, five times under the conditions of coating and following drying at 1000 rpm and 30 sec. and thereafter performing a heat treatment at 300° C. to form polyimide. The thickness of a PBI film formed on the Na-free glass substrate was 60 μm after the heat treatment.

This PBI target was sputtered under the conditions of an Ar pressure of 0.5 Torr and an RF power of 200 W, to form the heat resistant organic polymer insulating film 10*d* made of polybenzimidazole and having a thickness of 150 angstroms on the semiconductive film 10*c*.

In this embodiment, the resistance value of the charge preventive film 10*e* of the spacer 10 was measured after each process such as after assembly, after sealing to the face plate, after sealing to the rear plate, after vacuum evacuation, and after element electrode electric energization process. The resistance value hardly changed at each process.

Light emission spots, including those formed by emission electrons from the electron emitting elements 1 near the spacer 10, were formed at a two-dimensionally equal pitch, and an image with clear and good color reproductivity was able to be formed. This means that even if the spacers 10 were disposed, disturbance of an electric field which affects the electron trajectory was negligible. The resistance temperature coefficient of the material of the charge preventive film was −0.5% and a thermal runaway did not occur at Va=5 kV.

(Sixth Embodiment)

A different point of this embodiment from the fifth embodiment is that a film containing elements of W, B and N was used as the semiconductive film 10*c* of the spacer 10 shown in FIG. 1. An image forming apparatus shown in FIGS. 1 and 2 was manufactured in the manner similar to the fifth embodiment except the above-described different point.

The semiconductive film 10*c* containing elements of W, B and N used by this embodiment was formed by sputtering W and B targets at the same time in an atmosphere of mixture gas of argon and nitrogen, by using a sputtering system. The compositions of the semiconductive film 10*c* were adjusted by controlling the power used for each target to obtain an optimum resistance value. The substrate was grounded and exposed at a room temperature. The semiconductive film 10*c* containing elements of W, B and N had a film thickness of t=200 nm and a specific resistance of $\rho=2.7\times10^5$ Ωcm.

The heat resistant organic polymer insulating film 10*d* made of polybenzimidazole was formed by the method similar to the fifth embodiment to complete the spacer 10 of this embodiment.

In this embodiment, the resistance value of the charge preventive film 10*e* of the spacer 10 was measured after each process such as after assembly, after sealing to the face plate, after sealing to the rear plate, after vacuum evacuation, and after element electrode electric energization process. The resistance value hardly changed at each process.

Light emission spots, including those formed by emission electrons from the electron emitting elements 1 near the spacer 10, were formed at a two-dimensionally equal pitch, and an image with clear and good color reproductivity was able to be formed. This means that even if the spacers 10 were disposed, disturbance of an electric field which affects the electron trajectory was negligible. The resistance temperature coefficient of the material of the charge preventive film was −0.5% and a thermal runaway did not occur at Va=5 kV.

(Seventh Embodiment)

A different point of this embodiment from the first embodiment is the processes of forming the envelope 8 shown in FIGS. 1 and 2. An image forming apparatus shown in FIGS. 1 and 2 was manufactured in the manner similar to the first embodiment except the above-described different point. In the first embodiment, the envelope 8 was hermetically sealed by coating frit glass or conductive frit glass on predetermined area of the envelope 8 and baking it in an atmospheric air at 430° C. for 10 minutes or longer. In the seventh embodiment, the envelope 8 was hermetically sealed by the following processes.

(a) Frit glass was coated on the connection area between the face rear plate 2 and support frame 3 and on the connection area between the face plate 7 and support frame 31 dried at 120° C. to evaporate solvent, and baked in the atmospheric air at 380° C. to remove binder.

(b) Conductive frit glass containing silica spheres each coated with Au was coated on the face plate 7 in an area where the spacer 10 is bonded, dried at 120° C. to evaporate solvent, and baked in the atmospheric air at 380° C. to remove binder.

(c) after the rear plate 2, support frame 3, face plate 7 and spacers 10 were aligned in position at a desired position precision, the envelope 8 was hermetically sealed by heating it in a nitrogen atmosphere at 430° C. or 10 minutes or longer.

A resistance value of the charge preventive film 10*e* of the spacer 10 was measured before and after the above-described processes. The resistance value hardly changed before and after the processes.

(Eighth Embodiment)

A different point of this embodiment from the first embodiment is that the heating conditions in a vacuum state after the electric energization forming and activation processes for electron emitting elements were changed from 200° C. and 10 hours to 300° C. and 10 hours.

A resistance value of the charge preventive film 10*e* of the spacer 10 was measured before and after the heating process under the above-described conditions. The resistance value hardly changed before and after the process.

(Ninth Embodiment)

A different point of this embodiment from the first embodiment is that tin oxide ($SnO_2$) was used as the material of the semiconductive film 10*c* of the spacer shown in FIGS. 1 and 2. An image forming apparatus shown in FIGS. 1 and 2 was manufactured in the manner similar to the first embodiment except the above-described different point. In this embodiment, $SnO_2$ was deposited to a thickness of several ten angstroms by vacuum deposition, and a polyimide film was formed thereon by the method similar to the first embodiment. As compared to a comparison example to be described later, a change in the resistance value was small during the display manufacturing processes.

As above, the semiconductive film of each an island shape was able to improve the process stability by coating heat resistant polymer.

Even with the heating process in a reducing atmosphere of the seventh embodiment, a change in the resistance value of the semiconductive film made of $SnO_2$ or semiconductor oxide was reduced by coating heat resistant polymer.

While, instead of RF sputter for forming the neat resistant polymer film as in the above described embodiments, following process was used in forming a spacer 10. Then, a desirable advantage like the above embodiments could be obtained. That is, the present embodiment is different from the above described embodiments 1 to 4 and 7 to 9 in that as a surface coating layer (second layer), a polyimide thin film is formed to cover the first layer by the following process. The film thickness of the surface coating layer was 10 nm according to SAM observation. Preparing a soluting formed by deluting polyimide solution PIX-1500 available from Hitachi Chemical Co., Ltd. with NMP (N-2-mathylpyrrolidone) solution into 100 times of an original volume. The prepared liquid was printed on a substrate heated into 80° C. in a spray coating. The painted surface was dried. And, then the substrate is sintered at 350° C. for 30 minutes.

COMPARISON EXAMPLE

As a comparison example, the charge preventive film made of only $SnO_2$ was used. The resistance value changed greatly at each assembly process. After all the assembly processes, the specific resistance was 9.2 Ωcm and the resistance value of $1.8\times10^6\Omega$. Va was not able to be raised to 1 kV. Namely, the resistance changed greatly during the display manufacture processes, and the change amount was not constant. Therefore, there was a large variation in the resistance values after the processes, and resistance value controllability was less. In addition, because of the specific resistance of $SnO_2$, it was necessary to set the film thickness as thin as 1 nm or less, the resistance value controllability became more difficult.

ADVANTAGES OF THE INVENTION

The image forming apparatus described in the configuration and embodiments has the following advantages. First, a high quality image can be formed. It is possible to suppress the influence of spacers upon the image forming performance as much as possible. It is also possible to control the electrical characteristics of spacers to be changed by heat during the manufacture or drive process of the apparatus. During the drive process of the apparatus, the influence of gas emitted from spacers upon the image forming performance can be suppressed as much as possible.

What is claimed is:

1. An image forming apparatus comprising:

an envelope including as constituent elements first and second substrates spaced by some distance;

an electron source and an image forming member for forming an image upon irradiation of electrons from said electron source, said electron source and said image forming member being disposed in said envelope; and a spacer for maintaining the distance between the first and second substrates, wherein said spacer has a conductive region, and an outermost surface of the conductive region is covered with a heat resistant organic polymer film.

2. An image forming apparatus comprising:

an envelope including as constituent elements first and second substrates spaced by some distance;

an electron source and an image forming member for forming an image upon irradiation of electrons from said electron source, said electron source and said image forming member being disposed in said envelope; and a spacer for maintaining the distance between the first and second substrates, wherein said spacer comprises an insulating base member, a conductive film formed on the insulating base member, and a heat resistant organic polymer film covering an outermost surface of the conductive film.

3. An image forming apparatus according to claim 1 or 2, wherein said electron source is disposed on the first substrate, and said image forming member is disposed on the second substrate.

4. An image forming apparatus according to claim 3, wherein said electron source includes a plurality of electron emitting devices and wirings for wiring the plurality of electron emitting devices, said image forming member includes a fluorescent film and a metal back, and said spacer is abutted on said wiring and said metal back.

5. An image forming apparatus according to claim 1 or 2, wherein the heat resistant organic polymer film has a film thickness in a range from 10 angstroms to 500 angstroms.

6. An image forming apparatus according to claim 1 or 2, wherein the heat resistant organic polymer film is made of organic polymer having a ratio $N/M \leqq 0.4$ where N is a monomer valence electron number and M is a monomer molecular number.

7. An image forming apparatus according to claim 1 or 2, wherein the heat resistant organic polymer film is a polyimide film.

8. An image forming apparatus according to claim 1 or 2, wherein the heat resistant organic polymer film is a polybenzimidazole film.

9. An image forming apparatus according to claim 2, wherein the conductive film has a thickness in a range from 100 angstroms to 10000 angstroms.

10. An image forming apparatus according to claim 1, wherein said electron source has a plurality of surface conduction type electron emitting devices.

11. An image forming apparatus comprising:

an envelope including as constituent elements first and second substrates spaced by some distance;

an electron source and an image forming member for forming an image upon irradiation of electrons form said electron source, said electron source and said image forming member being disposed in said envelope; and a spacer for maintaining the distance between the first and second substrates, wherein said spacer has a conductive region, and an outermost surface of the conductive region is covered with a polymer film, wherein a ratio (N/M) of monomer valence electron number N to monomer molecular weight M meets a relation: $N/M \leqq 0.4$.

12. An image forming apparatus comprising:

an envelope including as constituent elements first and second substrates spaced by some distance;

an electron source and an image forming member for forming an image upon irradiation of electrons from said electron source, said electron source and said image forming member being disposed in said envelope; and a spacer for maintaining the distance between the first and second substrates, wherein said spacer comprises an insulating base member, a conductive film formed on the insulating base member, and a polymer film, wherein a ratio (N/M) of monomer valence electron number N to monomer molecular weight M meets a relation: $N/M \leqq 0.4$, covering an outermost surface of the conductive film.

* * * * *

UNITED STATES PATENT AND TRADEMARK OFFICE

CERTIFICATE OF CORRECTION

PATENT NO. : 6,566,794 B1
DATED : May 20, 2003
INVENTOR(S) : Kazuya Miyazaki

It is certified that error appears in the above-identified patent and that said Letters Patent is hereby corrected as shown below:

Column 1,
Line 57, “the” should read -- to the --; and
Line 61, “at” should be deleted.

Column 3,
Line 29, “envelope,,” should read -- envelope, --.

Column 4,
Line 3, “does.” should read -- does --;
Line 38, “ncm.” should read -- Ωcm. --; and
Line 60, “Zt,” should read -- Zr, --.

Column 5,
Line 26, “((NIM)” should read -- ((N/M) --;
Line 47, “does” should read -- is --; and
Line 53, “be taking” should read -- by taking --.

Column 7,
Line 61, “place” should read -- plate --.

Column 9,
Line 13, “is” should read -- are --;
Line 16, “is” should read -- is a --; and
Line 17, “factors” should read -- factor --.

Column 16,
Line 23, “Hdispose” should read -- dispose --.

Column 18,
Line 13, “Nafree” should read -- NA-free --.

UNITED STATES PATENT AND TRADEMARK OFFICE

CERTIFICATE OF CORRECTION

PATENT NO. : 6,566,794 B1
DATED : May 20, 2003
INVENTOR(S) : Kazuya Miyazaki

It is certified that error appears in the above-identified patent and that said Letters Patent is hereby corrected as shown below:

Column 21,
Line 30, “soluting” should read -- solution --; and
Line 31, “deluting” should read -- diluting --.

Column 22,
Line 59, “form” should read -- from --.

Signed and Sealed this

Ninth Day of December, 2003

JAMES E. ROGAN
*Director of the United States Patent and Trademark Office*